US008362985B2

(12) United States Patent
Seto

(10) Patent No.: US 8,362,985 B2
(45) Date of Patent: Jan. 29, 2013

(54) ORGANIC EL DISPLAY DEVICE AND METHOD OF DRIVING THEREOF

(75) Inventor: Yasuhiro Seto, Kanagawa (JP)

(73) Assignee: Fujifilm Corporation (JP)

( * ) Notice: Subject to any disclaimer, the term of this patent is extended or adjusted under 35 U.S.C. 154(b) by 603 days.

(21) Appl. No.: 12/478,474

(22) Filed: Jun. 4, 2009

(65) Prior Publication Data

US 2009/0309863 A1 Dec. 17, 2009

(30) Foreign Application Priority Data

Jun. 13, 2008 (JP) ..... 2008-155442

(51) Int. Cl.
*G09G 3/32* (2006.01)

(52) U.S. Cl. ..... 345/82

(58) Field of Classification Search ..... 345/82, 345/76

See application file for complete search history.

(56) References Cited

U.S. PATENT DOCUMENTS

| | | | | |
|---|---|---|---|---|
| 2005/0206590 | A1* | 9/2005 | Sasaki et al. | 345/76 |
| 2007/0126665 | A1* | 6/2007 | Kimura | 345/76 |
| 2007/0236424 | A1 | 10/2007 | Kimura | |
| 2007/0273620 | A1 | 11/2007 | Yumoto | |
| 2008/0001545 | A1* | 1/2008 | Uchino et al. | 315/175 |
| 2008/0062096 | A1* | 3/2008 | Yamashita et al. | 345/82 |
| 2008/0218455 | A1* | 9/2008 | Yamamoto et al. | 345/76 |
| 2011/0024760 | A1 | 2/2011 | Kimura | |
| 2011/0260170 | A1 | 10/2011 | Kimura | |
| 2012/0188466 | A1 | 7/2012 | Kimura | |

FOREIGN PATENT DOCUMENTS

| | | | |
|---|---|---|---|
| JP | 8-234683 | A | 9/1996 |
| JP | 2003-255856 | A | 9/2003 |
| JP | 2003-271095 | A | 9/2003 |
| JP | 2007-298973 | A | 11/2007 |
| JP | 2007-310311 | A | 11/2007 |
| JP | 2007-316454 | A | 12/2007 |
| JP | 2008-65200 | A | 3/2008 |

OTHER PUBLICATIONS

Japanese Office Action "Notice of Reasons for Rejection" dated Jul. 31, 2012; Japanese Patent Application No. 2008-155442; with translation.

* cited by examiner

*Primary Examiner* — Chanh Nguyen
*Assistant Examiner* — John Kirkpatrick
(74) *Attorney, Agent, or Firm* — Studebaker & Brackett PC; Donald R. Studebaker

(57) ABSTRACT

A display device includes plural scan lines, plural data lines intersecting the of scan lines, plural discharge lines for the respective scan lines; and plural pixel circuits for respective intersections of the scan lines and the data lines. Each of the pixel circuits includes a driving transistor, a first diode in which the cathode is connected to a power supply voltage line and the anode is connected to the source of the driving transistor, a retention capacitor connected between the gate and the source of the driving transistor, a selection transistor in which one of the drain and the source being connected to a data line and the other being connected to the gate of the driving transistor, and a second diode in which the cathode is connected to a discharge line and the anode is connected to the source of the driving transistor.

5 Claims, 24 Drawing Sheets

ORGANIC EL DISPLAY DEVICE AND METHOD OF DRIVING THEREOF

CROSS-REFERENCE TO RELATED APPLICATION

This application claims priority under 35 USC 119 from Japanese Patent Application No. 2008-155442 filed on Jun. 13, 2008, the disclosure of which is incorporated by reference herein.

BACKGROUND OF THE INVENTION

1. Field of the Invention

The present invention relates to an active matrix system organic electric luminescence (EL) display device, and to a method of driving thereof.

2. Description of the Related Art

Current controlling type organic light-emitting diodes (OLEDs) are used in active matrix system organic EL display devices. Accordingly, a selection transistor, a retention capacitor, and a driving transistor are required, which is different than in a liquid crystal display (LCD).

Conventionally, a thin film transistor (TFT) made of low-temperature polysilicon or amorphous silicon is used as the driving transistor, as disclosed in Japanese Patent Application Laid-Open (JP-A) No. 8-234683. A low-temperature polysilicon TFT may provide a high mobility and threshold voltage stability, but there are problems with the uniformity of the mobility. An amorphous silicon TFT may provide uniformity of the mobility, but there are problems with the mobility being low and fluctuations in the threshold voltage over time.

Low uniformity of the mobility and threshold voltage stability are expressed as unevenness of the displayed image. Accordingly, as disclosed in JP-A No. 2003-255856, in the case of using an amorphous silicon TFT, compensation circuits of a diode connection system are provided within the pixel circuits, and threshold voltage correction by the parasitic capacitances of the OLEDs is performed. However, when such compensation circuits are provided, the pixel circuits become complex, which may lead to an increase in costs due to a deterioration in yield, and a decrease in the aperture ratio.

Thus, as threshold voltage correction of a diode connection system, JP-A No. 2003-271095 proposes a method of reducing the number of transistors by correcting the threshold voltage by charging operation to the OLED parasitic capacitances.

FIG. 12 is a drawing showing the pixel circuit structure disclosed in JP-A No. 2003-271095.

The pixel circuit shown in FIG. 12 has a selection gate connecting switch 100, a retention capacitor 102, a driving transistor 104, a current controlling element (OLED) 106, a parasitic capacitance 108 and a reset switch 110. The selection gate connecting switch 100 is formed from a thin film transistor. The gate thereof is connected to a row scan signal line (hereinafter called Scan line) 112, and one of the drain and the source is connected to a column data signal line (hereinafter called Data line) 114, and the other of the drain and the source is connected to the gate of the driving transistor 104.

The retention capacitor 102 is connected between the gate and the source of the driving transistor 104. The driving transistor 104 is formed from a thin film transistor. The gate thereof is connected to one of the drain and the source of the selection gate connecting switch 100, and to one end of the retention capacitor 102. The drain of the driving transistor 104 is connected to power supply Vdd, and the source is connected to the anode of the OLED 106.

The anode of the OLED 106 is connected to the source of the driving transistor 104, and the cathode is grounded. The OLED 106 emits light at a luminance that corresponds to the magnitude of the current of the driving transistor 104. The parasitic capacitance 108 is a parasitic capacitance between the electrodes of the OLED 106.

The reset switch 110 is connected between, on the one hand, the source of the driving transistor 104, and, on the other hand, the OLED 106 and the parasitic capacitance 108, and is connected to one end of the retention capacitor 102. The reset switch 110 is connected to a row reset signal line (hereinafter called Res line) 116, and turns on and off in accordance with a Reset signal supplied from the Res line 116.

Operation of the pixel circuit shown in FIG. 12 will be described here with reference to FIG. 13 through FIG. 17. FIG. 13 is a drawing showing examples of voltage waveforms during the operation time periods of the circuit. Vs is the source voltage of the driving transistor 104, and Vgs is the voltage between the gate and source of the driving transistor 104.

Time periods T1 through T4 shown in FIG. 13 are time periods expressing one display period of the pixel circuit. The time period before T1 of FIG. 13 shows the previous display period. Accordingly, during this previous display period, the voltage value that is applied to the Data line 114, the source voltage Vs of the driving transistor 104, and the voltage Vgs between the gate and the source of the driving transistor 104 are voltages corresponding to the previous display period. Here, the voltage ranges thereof are shown by mesh shading, and without the values thereof being specified in particular.

FIG. 14 through FIG. 17 are drawings schematically showing the on/off states and the flow of current of the selection gate connecting switch 100 and the reset switch 110 during the respective operation time periods that will be described hereinafter.

In time period T1 shown in FIG. 13, resetting operation is performed. In this resetting time period T1, the selection gate connecting switch 100 is turned on as shown in FIG. 14 due to a Scan signal that is supplied to the Scan line 112 by an unillustrated Scan driver, and voltage VB that is supplied to the Data line 114 by an unillustrated Data driver is applied to the gate of the driving transistor 104. Given that the light-emitting threshold voltage of the OLED 106 is Vf0 and the threshold voltage of the driving transistor 104 is Vth, the voltage VB that satisfies the condition "Vth<VB<Vf0+Vth" is applied to the gate of the driving transistor 104.

Further, in this resetting time period T1, the reset switch 110 is turned on due to a Reset signal that is supplied to the Res line 116 simultaneously with the Scan signal, the retention capacitor 102 and the parasitic capacitance 108 are discharged, and the source voltage Vs of the driving transistor 104 becomes 0 V. The resetting operation time period T1 is set in advance as the time period needed in order for the source voltage Vs of the driving transistor 104 to become 0 V.

In the technique disclosed in exemplary embodiment 1 of JP-A No. 2003-271095, this resetting operation is realized by natural discharging of OLED leak current, without providing the reset switch 110.

In time period T2 shown in FIG. 13, a threshold voltage detecting operation is performed. When time period T1 ends and time period T2 is started, the Reset signal is set to the non-selection level, and, as shown in FIG. 15, the reset switch 110 is turned off.

At the time of the start of T2, the source voltage Vs of the driving transistor 104 is 0 V, and the gate voltage Vg is the voltage VB. Therefore, the voltage Vgs between the gate and the source is Vgs>Vth, and current Id corresponding to the voltage Vgs between the gate and the source flows to the driving transistor 104.

Due to this current Id, the parasitic capacitance 108 is charged, and the source voltage Vs rises. Because the gate voltage Vg is fixed to Vg=VB, as the source voltage Vs rises, the voltage Vgs between the gate and the source decreases and the current Id decreases. In this process, the voltage Vgs between the gate and the source of the driving transistor 36 gradually approaches the threshold voltage Vth.

Then, when the current Id has become sufficiently small, the rise in the source voltage Vs stops.

Here, the saturated region current formula of a thin film transistor (TFT) is expressed as $$Id=\mu*Cox*(W/L)*(Vgs-Vth)^2$$

where μ is the mobility, Cox is the electrostatic capacity per unit surface area of the gate insulating film, W is the channel width and L is the channel length. Therefore, voltage Vcs that is written to the retention capacitor 102 at this time is Vcs=Vgs=Vth.

A condition in order to make current not flow to the OLED 106 so that that OLED 106 does not emit light is that the source voltage Vs satisfies $$Vs=VB-Vth<Vf0.$$

Accordingly, as described above, the voltage VB will be $$VB<Vf0+Vth.$$

In the time period of T3 shown in FIG. 13, programming operation is performed. Here, the operation of setting the current that is desired to flow to the driving transistor 104 in actuality (i.e., making the retention capacitor 102 hold the voltage for making the current flow) is called programming operation. At the start of the programming operation time period T3, as shown in FIG. 16, the Data signal voltage of the Data line 114 is stepped-up from VB to VB+Vod. Accordingly, the gate voltage Vg of the driving transistor 104 becomes VB+Vod.

Here, Vod is the overdrive voltage of the driving transistor 104, and is $$Vod=Vgs-Vth.$$

The source voltage Vs is the divided voltage of the retention capacitor 102 and the parasitic capacitance 108. Therefore, given that the capacity of the retention capacitor 102 is Cs and the capacity of the parasitic capacitance 108 is Cd, the source voltage Vs is expressed as $$Vs=VB-Vth+Vod*Cs/(Cd+Cs).$$

However, if the capacity Cd of the parasitic capacitance 108 is greater by far than the capacity Cs of the retention capacitor 102 (Cd>>Cs), the source voltage Vs will be substantially equal to "VB−Vth". Therefore, the voltage Vgs between the gate and the source of the driving transistor 104 becomes $$Vgs=Vg-Vs=(VB+Vod)-(VB-Vth)=Vth+Vod.$$

Thus, voltage that is substantially obtained by adding the overdrive voltage Vod to the threshold voltage Vth detected in the threshold voltage detection time period T2, is set at the retention capacitor 102 that is positioned between the gate and the source of the driving transistor 104. The voltage that is set here is called the program voltage.

In the time period of T4 shown in FIG. 13, light-emitting operation is performed. In the time period of the light-emitting time period T4 of FIG. 13, a voltage value corresponding to the next display time period is applied to the Data line 114. Here, the voltage range thereof is shown by mesh shading without specifying the Data signal voltage in particular.

In the light-emitting time period T4, the Scan signal becomes the non-selection level, and, as shown in FIG. 17, the selection gate connecting switch 100 turns off. Further, the voltages at both ends of the retention capacitor 102 are held as is. Due to the current Id that flows to the driving transistor 104, the parasitic capacitance 108 of the OLED 106 is charged, and the source voltage Vs rises. Moreover, the voltage Vgs between the gate and the source of the driving transistor 104 holds the program voltage as is. Accordingly, before long, the source voltage Vs exceeds the light-emitting threshold voltage Vf0 of the OLED 106, and the OLED 106 emits light.

The selection gate connecting switch 100 must be turned off at the time after application of the aforementioned overdrive voltage Vod is completed and before the source voltage Vs starts to rise.

Further, JP-A No. 2007-310311 discloses a device that adds a mobility μ correcting function to the above-described technique disclosed in JP-A No. 2003-271095.

FIG. 18 is a drawing showing the pixel circuit structure disclosed in JP-A No. 2007-310311. In FIG. 18, structural elements to which the same numerals as in FIG. 12 are applied are the same structural elements as in FIG. 12.

The pixel circuit shown in FIG. 18 has the selection gate connecting switch 100, the retention capacitor 102, the driving transistor 104, the OLED 106 and the parasitic capacitance 108. The relationships of connection among these respective elements are the same as in FIG. 12. However, the reset switch 110 is not provided in the circuit of FIG. 18. Further, the drain of the driving transistor 104 is connected to a power supply line (hereinafter called Vddx line) 118 that is common to the row.

The operation of the pixel circuit shown in FIG. 18 will be described with reference to FIG. 19, with the main point being the function of correcting the mobility μ. FIG. 19 is a drawing showing examples of the voltage waveforms during the operation time periods of the circuit.

In time period T1 shown in FIG. 19, resetting operation is performed. In this resetting time period T1, the selection gate connecting switch 100 is turned on due to the Scan signal that is supplied to the Scan line 112 by the unillustrated Scan driver, and the voltage VB that is supplied to the Data line 114 by the unillustrated Data driver is applied to the gate of the driving transistor 104. In the same way as in FIG. 12, given that the light-emitting threshold voltage of the OLED 106 is Vf0 and the threshold voltage of the driving transistor 104 is Vth, the voltage VB that satisfies the condition "Vth<VB<Vf0+Vth" is applied to the gate of the driving transistor 104.

Here, power supply voltage Vddx that is supplied from the Vddx line 118 is set to "Vddx=VL<VB−Vth". Namely, the power supply voltage Vddx is made to be less than VB. Due thereto, the driving transistor 104 turns on, and, at the driving transistor 104, current flows from the parasitic capacitance 108 side to the Vddx line 118 side. Accordingly, the parasitic capacitance 108 of the OLED 106 discharges to the Vddx line 118, and finally, the source voltage Vs of the driving transistor 104 becomes 0 V. In this way, discharging of the parasitic capacitance 108 is performed without providing the reset switch 110 in this structure.

In the time period of T2 shown in FIG. 19, threshold voltage detecting operation is performed. Because the threshold voltage detecting operation performed here is similar to the case of the structure of FIG. 12, description is omitted.

In the first half of the time period of T3 shown in FIG. 19, programming operation is performed. Because the programming operation performed here also is similar to the case of the structure of FIG. 12, description is omitted.

In the second half of the time period of T3 shown in FIG. 19, i.e., after the programming operation, correction operation of the mobility μ is performed, and the program voltage is corrected.

In the technique disclosed in JP-A No. 2003-271095 described in FIG. 12, when the programming operation finishes, the Scan signal is immediately made to be non-selection level and the light-emitting operation is started. However, here, the Scan signal is maintained at the selection level and the selection gate connecting switch 100 is held in the on state for a set time (=Tx) after completion of the programming operation.

During this time, the current Id, that corresponds to the programmed voltage Vod, flows to the driving transistor 104. The current Id is charged to the parasitic capacitance 108, and, as shown in FIG. 19, the source voltage Vs of the driving transistor 104 rises again. Given that the voltage that again rises is ΔV, ΔV can be expressed by the following formula.

$$\Delta V = Tx * Id / Cd$$

Here, given that the time Tx and the capacity Cd of the parasitic capacitance 108 are common to all of the pixels, ΔV is a function of the current Id.

Further, as mentioned previously, the saturated region current formula of a TFT is $$Id = \mu * Cox * (W/L) * (Vgs - Vth)^2,$$

and the threshold voltage Vth is already corrected in time period T2. Therefore, $$Id = \mu * Cox * (W/L) * Vod^2.$$

Accordingly, ΔV will be a voltage corresponding to ρ*Cox*(W/L) of each driving transistor 104, and the voltage Vcs of the retention capacitor 102 is held at a voltage "Vth+Vod−ΔV" that is obtained by subtracting ΔV from the voltage Vgs between the gate and the source (as described previously, Vgs=Vth+Vod). Due thereto, the μ deviations of the driving transistors 104 of each of the pixels are cancelled. Namely, the greater the mobility μ, the larger the ΔV. The smaller the mobility μ, the smaller the ΔV. Therefore, the program voltage is corrected by this deviation.

In time period T4 shown in FIG. 19, light-emitting operation is performed. In the light-emitting time period T4, the Scan signal is set to the non-selection level, and the selection gate connecting switch 100 turns off. Further, while the voltages at both ends of the retention capacitor 102 are held as is, the parasitic capacitance 108 of the OLED 106 is charged with the current Id that flows to the driving transistor 104, and the source voltage Vs rises. The voltage Vgs between the gate and the source of the driving transistor 104 remains retention the program voltage. Accordingly, eventually, the source voltage Vs exceeds the light-emitting threshold voltage Vf0 of the OLED 106, and the OLED 106 emits light.

However, there are the following problems in the above-described conventional art.

In the techniques disclosed in above-described JP-A No. 2003-271095 and JP-A No. 2007-310311, in the resetting time period T1, the source voltage Vs of the driving transistor 104 must be reset (made to be 0 V in the above example) in the initial state. This is realized by natural discharging of OLED leak current in the circuit disclosed in exemplary embodiment 1 of JP-A No. 2003-271095, and is realized by controlling the power supply voltage with respect to the driving transistor 104 and discharging to the power supply line 118 via the driving transistor 104 in the circuit disclosed in JP-A No. 2007-310311.

However, in both, a certain amount of time is needed for the discharging, and incorporation into a panel of a large number of pixels is difficult due to the restrictions on the program time period.

Therefore, as described in FIG. 12, a transistor switch for OLED parasitic capacitance discharge, that is for actively making the source voltage Vs of the driving transistor 104 be the reset voltage (0 V in this case), i.e., the reset switch 110 as described above, is needed. However, separately providing such a reset switch 110 becomes a primary factor in increased costs due to decreased yield, and in decreased lifespan due to a decreased OLED aperture ratio.

Moreover, there is the problem of errors in threshold voltage detection, due to color pixel deviations between pixels of plural reference colors, of the parasitic capacitances of the diode elements. Here, the problem of color deviations will be described with reference to FIG. 12, FIG. 18 and FIG. 20 through FIG. 24 that illustrate structures of conventional art.

In the above-described technique disclosed in JP-A No. 2003-271095, in the operation of detecting the threshold voltage Vth, the voltage Vgs between the gate and the source when the current Id becomes sufficiently small and the rise in the source voltage Vs stops, is set as the threshold voltage Vth. However, in an actual TFT, voltage (Von) at which the current actually flows-out and the threshold voltage Vth of the saturation region current formula differ due to the current characteristics of the sub-threshold region (here, the sub-threshold region means a region that is less than or equal to Vth).

The overdrive voltage Vod, that is set in the programming operation in time period T3, is voltage that is computed from the saturation region current formula. The voltage for which determination is desired in the threshold voltage Vth detecting operation is the Vth in the current formula, and is not Von. However, the voltage that is actually detected in the threshold voltage Vth detecting operation in the technique of JP-A No. 2003-271095 is the voltage Von that is different from the threshold voltage Vth in the current formula.

This point will be explained with reference to FIG. 20 and FIG. 21.

FIG. 20 is an example of a graph showing Vgs-Id characteristics of TFTs. In this graph, Vgs is shown on the X-axis and Id is shown on the Y-axis. The Vgs-Id characteristic of a TFT whose sub-threshold region current is small is shown by the thick line, and the Vgs-Id characteristic of a TFT whose sub-threshold region current is large is shown by the thin line. Although the difference between the two is not remarkable in this graph, the difference becomes clear when the relationship between the square root of the current Id and Vgs is graphed. FIG. 21 is an example of a graph showing Vgs-√Id characteristics. In this graph, Vgs is shown on the X-axis and √Id is shown on the Y-axis. In the same way as in FIG. 20, the Vgs-√Id characteristic of a TFT whose sub-threshold region current is small is shown by the thick line, and the Vgs-√Id characteristic of a TFT whose sub-threshold region current is large is shown by the thin line. Moreover, the straight line showing the threshold voltage Vth in the saturated region current formula (the calculated straight line of the threshold voltage Vth) is shown by the dashed line.

As is clear from FIG. 21, the threshold voltage that is shown by the extrapolated X intercept of the computed straight line of the threshold voltage Vth here is Vth=1.46 V. This value is the value that is desired to be set in the programming operation. However, due to the current characteristics of the sub-threshold region, the current Id when Vgs=Vth is different. Namely, the voltage Von at which current actually flows-out is lower than the Vth that is determined by the computed straight line of the threshold voltage Vth, and the value thereof differs in accordance with the current characteristics of the sub-threshold region (refer to Von1, Von2 of FIG. 21).

This means that, in the threshold voltage Vth detection operation at the above-described conventional pixel circuit, in order to detect Vth and not Von, the charging of the retention capacitor 102 is needed to be stopped when a predetermined time period elapses, before the rise of the source voltage Vs is saturated.

The threshold voltage Vth detection time period is determined by the current characteristics of the sub-threshold region of the driving transistor 104 and the magnitude (capacity) of the parasitic capacitance 108.

Here, the relationship between the capacity of the parasitic capacitance 108 and the threshold voltage detection time period, of each current characteristic of the sub-threshold region, will be described with reference to FIG. 22 and FIG. 23.

FIG. 22 is a graph showing examples of the results of simulation of threshold voltage detection operation in cases in which the capacity Cd of the parasitic capacitance 108 is 2 pF and 4 pF, at a TFT whose sub-threshold region current is small.

FIG. 23 is a graph showing examples of the results of simulation of threshold voltage detection operation in cases in which the capacity Cd of the parasitic capacitance 108 is 2 pF and 4 pF, at a TFT whose sub-threshold region current is large.

In both graphs, the horizontal axis is the threshold voltage Vth detection time period t(s), and the vertical axis is the voltage Vgs between the gate and the source. The results of simulation in the cases in which the capacity Cd is 4 pF are shown by the thick lines, and the results of simulation in the cases in which the capacity Cd is 2 pF are shown by the thin lines. The dashed lines in the graphs show the threshold voltage of 1.46 V.

As is clear from FIG. 22, in the case of the TFT whose sub-threshold region current is small, the threshold voltage detection time period is around 50 μs in all cases. Even if the capacity Cd of the parasitic capacitance 108 varies, the threshold voltage detection time period does not change, and therefore, large errors do not arise in the detected value of the threshold voltage Vth.

On the other hand, as is clear from FIG. 23, in the case of the TFT whose sub-threshold region current is large, the threshold voltage detection time period is around 20 μs in the case in which the capacity Cd is 4 pF. However, in the case in which the capacity Cd is 2 pF, the threshold voltage detection time period varies greatly, and a large error will arise in the detected value of the threshold voltage Vth.

From the above, it can be understood that the threshold voltage Vth detection time period varies greatly in accordance with the magnitude of the parasitic capacitance 108 when a TFT whose sub-threshold region current is large is used as the driving transistor 104 in an organic EL display device.

The capacity of the parasitic capacitance 108 of the OLED 106 is usually around 150 to 300 pF/mm$^2$. This value is determined mainly from the relative permittivity (dielectric constant) and the film thickness of the organic light-emitting material. The dielectric constant and the film thickness differ in accordance with the color (RGB) of the OLED 106, and therefore, the parasitic capacity differs at each color of the OLEDs 106.

Generally, in an active matrix system organic EL display device, the lines of each color in which pixels per color of RGB are lined-up in the column direction (the Data line direction) are structured so as to be disposed in order of, for example, RGBRGB . . . in the row direction (the Scan line direction). Because the respective pixel circuits on a same Scan line are controlled at the same timing, the detection time periods of the threshold voltage Vth are common for RGB. However, as described above, in the case of a driving transistor 104 whose sub-threshold region current is large, the threshold voltage Vth detection time period depends on the magnitude of the parasitic capacitance 108 of the OLED 106, and therefore, errors in detection of the threshold voltages Vth arise due to capacity deviations between each pixels of RGB (RGB deviations).

Also in the pixel circuit that performs μ correction that is disclosed in JP-A No. 2007-310311, ΔV =Tx*Id/Cd, and the RGB deviations of the parasitic capacitances 108 are a cause of errors.

As a method of addressing the above fact, as shown in FIG. 24, there is a method of setting, at each pixel, a correction capacitor 120 that makes the electrostatic capacity that is connected to the source of the driving transistor 104 to be the same among pixels of RGB. However, this leads to a decrease in the OLED lifespan due to a decrease in the aperture ratio, and to an increase in costs due to a decrease in yield.

SUMMARY OF THE INVENTION

In view of the above-described circumstances, the present invention provides a display device and a driving method that, in a system that corrects threshold voltage by the operation of charging to a parasitic capacitance of a light-emitting element, can reset the source voltage of a driving transistor in a short time without adding a transistor.

An aspect of the present invention is a display device including: plural scan lines arranged in parallel; plural data lines arranged in parallel in a direction intersecting the plural scan lines; plural discharge lines respectively arranged in correspondence with the respective scan lines; and plural pixel circuits disposed in correspondence with respective intersections of the plural scan lines and the plural data lines, each of the pixel circuits including: a driving transistor including a gate and a source; a first diode element having a cathode which is connected to a power supply voltage line and having an anode which is connected to the source of the driving transistor, the first diode element emitting reference color light in accordance with operation of the driving transistor; a retention capacitor connected between the gate and the source of the driving transistor; a selection transistor having a drain and a source, one of the drain and the source being connected to a data line of the plural data lines and the other of the drain and the source being connected to the gate of the driving transistor, the selection transistor turning on and off in accordance with a scan signal from a scan line of the plural scan lines; and a second diode element having a cathode which is connected to a discharge line of the plural discharge lines and having an anode which is connected to the source of the driving transistor.

BRIEF DESCRIPTION OF THE DRAWINGS

Exemplary embodiments of the present invention will be described in detail based on the following figures, wherein.

DETAILED DESCRIPTION OF THE INVENTION

Figure 1:
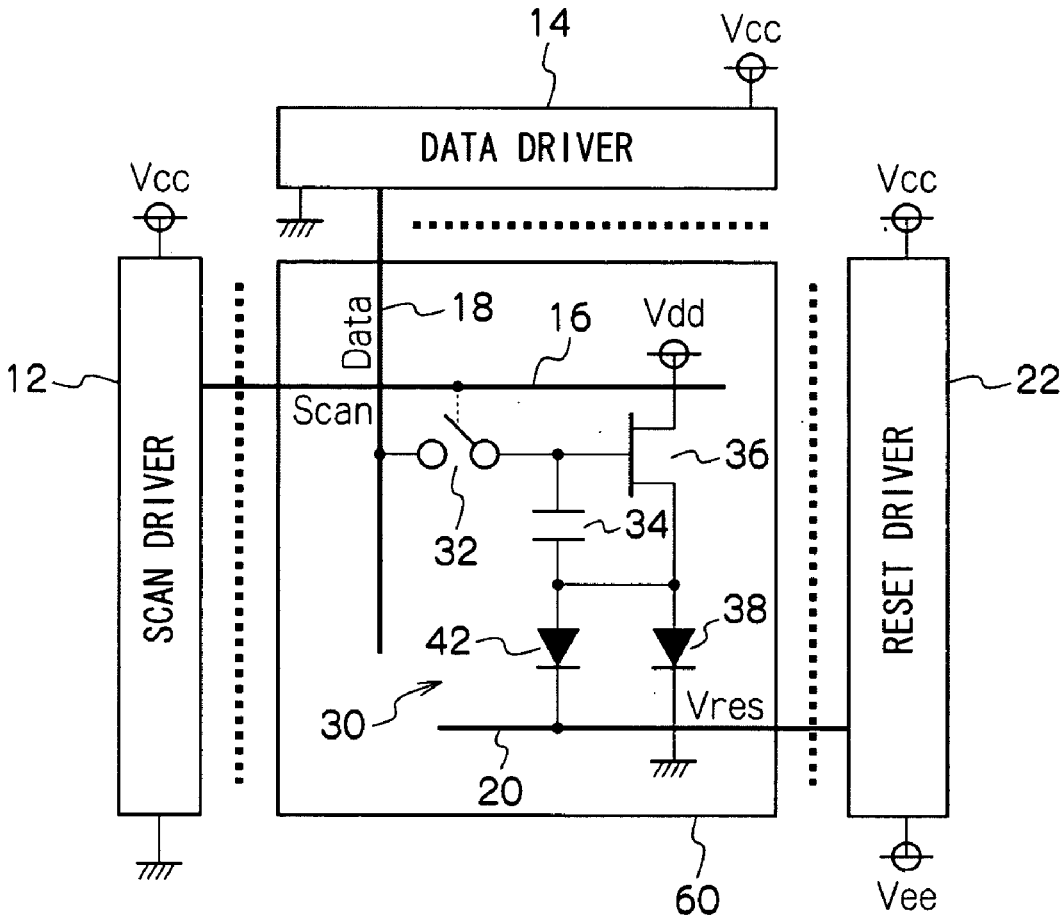
FIG. 1 is a drawing showing the overall structure of a display device relating to an exemplary embodiment.
Figure 2:
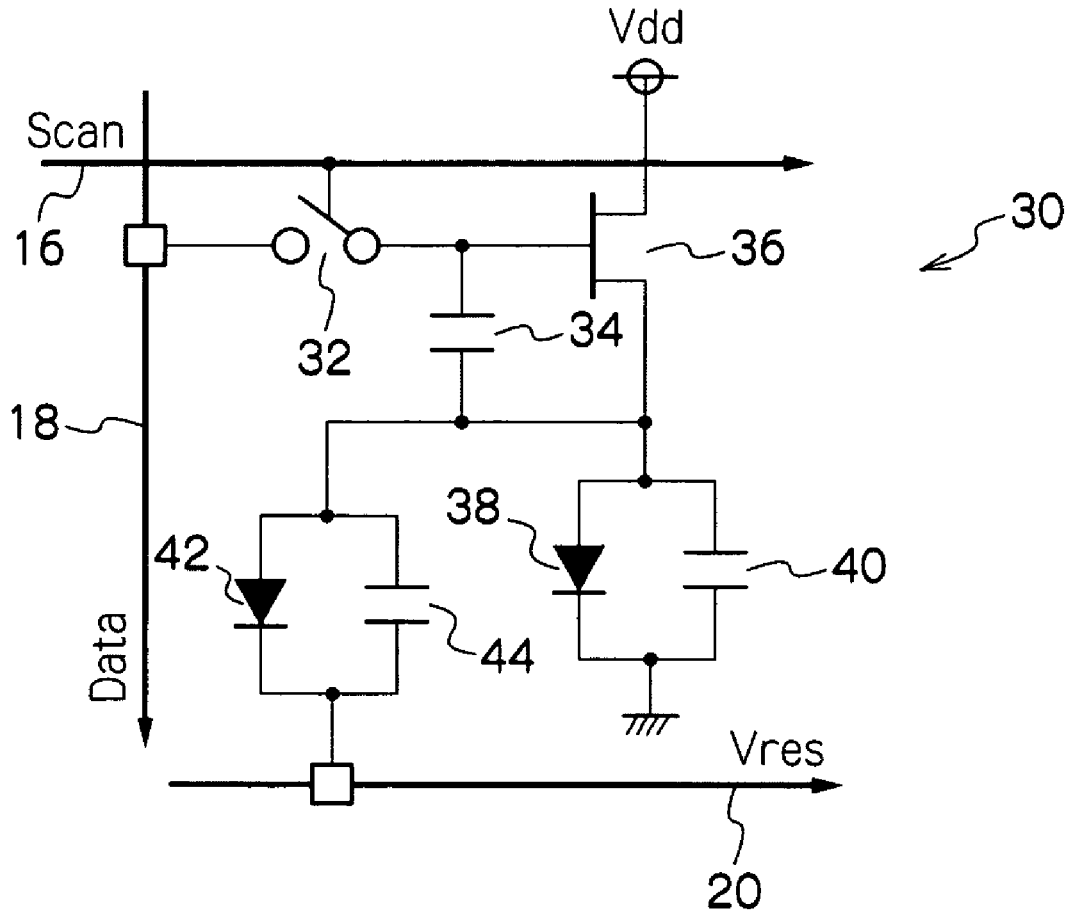
FIG. 2 is a drawing showing an example of a pixel circuit of each pixel included in the display device relating to the exemplary embodiment.

FIG. 1 is a drawing showing the overall structure of a display device 10 relating to an exemplary embodiment of the present invention. FIG. 2 is a drawing showing an example of a pixel circuit 30 of each pixel included in the display device 10.

The display device 10 is an active matrix driving type organic EL display device that uses thin film transistors (TFTs). As shown in FIG. 1, the display device has a scan driver 12 and a data driver 14, and has a display panel 60 that is formed from: plural row scan signal lines (hereinafter called Scan lines) 16 that are connected to the scan driver 12 and arranged in parallel; plural column data signal lines (hereinafter called Data lines) 18 that are connected to the data driver 14 and are arranged in parallel in a direction intersecting the Scan lines 16; and plural pixel circuits 30 that are disposed at the intersections of the Scan line 16 and the Data lines 18. Namely, the respective pixel circuits 30 are disposed in the form of a matrix (the form of rows and columns). Note that, in FIG. 1, only the pixel circuit 30 of one pixel is shown at the display panel 60.

The display device 10 has plural Vres lines 20 that are arranged respectively for the respective Scan lines 16, and a reset driver 22 that supplies reset signals (Vres signals) to the respective Vres lines 20.

In the display device 10, current corresponding to luminance information (data) is supplied to the pixel circuits 30 by the scan driver 12 providing Scan signals to the Scan lines 16 during a pixel selecting time period, and the data driver 14 providing Data signals to the Data lines 18 during the pixel selecting time period.

As shown in FIG. 2, the pixel circuit 30 of each pixel has a selection gate connecting switch 32, a retention capacitor 34, a driving transistor 36, an OLED (organic light-emitting diode) 38 for light emission, a parasitic capacitance 40 of the light emission OLED 38, an OLED 42 for discharging, and a parasitic capacitance 44 of the discharging OLED 42. In the exemplary embodiment, one OLED is divided at a predetermined division surface area ratio, such that one portion thereof structures the light emission OLED 38 and the other structures the OLED 42 for discharging. Accordingly, the light emission OLED 38 and the discharging OLED 42 are organic light-emitting diodes having the same light-emitting threshold voltage Vf0.

The selection gate connecting switch 32 is formed from an N-type thin film transistor. The gate thereof is connected to the Scan line 16, one of the drain and the source is connected to the Data line 18, and the other of the drain and the source is connected to the gate of the driving transistor 36.

The retention capacitor 34 is connected between the gate and the source of the driving transistor 36.

The driving transistor 36 is formed from an N-type thin film transistor. The gate thereof is connected to one of the drain and the source of the selection gate connecting switch 32, and to one end of the retention capacitor 34. The drain of the driving transistor 36 is connected to the power supply Vdd, and the source is connected to the anode of the light emission OLED 38 and to the anode of the discharging OLED 42.

The anode of the light emission OLED 38 is connected to the source of the driving transistor 36, and the cathode is grounded. The light emission OLED 38 emits light at a luminance that corresponds to the current of the driving transistor 36. The parasitic capacitance 40 is the parasitic capacitance of the both ends of the light emission OLED 38.

The anode of the discharging OLED 42 is connected to the source of the driving transistor 36, and the cathode is connected to the Vres line 20. The parasitic capacitance 44 is the parasitic capacitance of the both ends of the discharging OLED 42.

The display device 10 of the exemplary embodiment is a device that causes light of the respective colors of RGB to be emitted by the OLEDs 38 that are included in the pixel circuits 30 of the respective pixels, and displays a color image. The display device 10 is structured by pixel rows per color of RGB, in which pixels that emit light of the same color are arranged along the column direction (the direction in which the Data lines 18 extend), being repeatedly disposed in a predetermined order (here, in the order of RGBRGB . . . ) in the row direction (the direction in which the Scan lines 16 extend).

Figure 3:
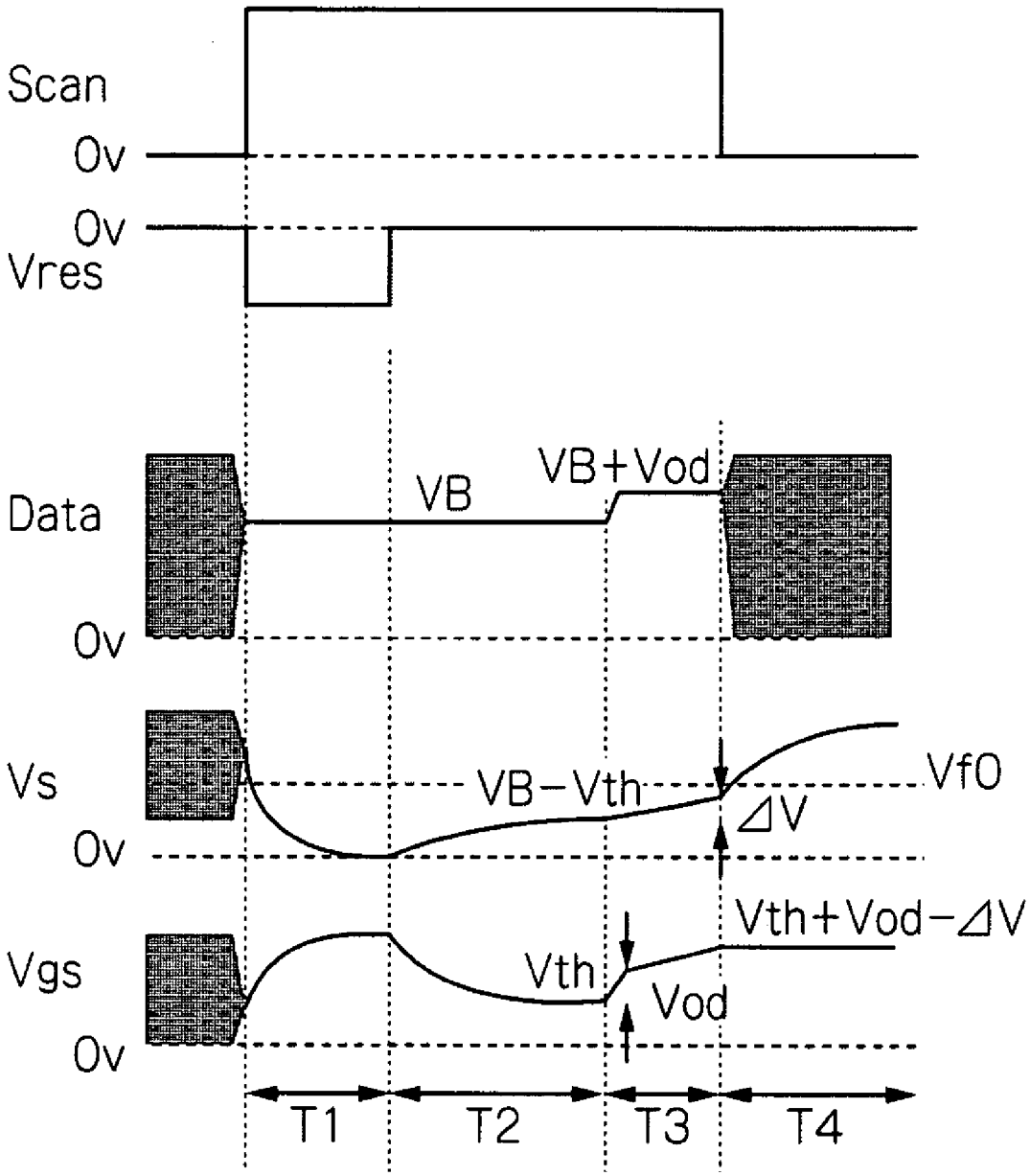
FIG. 3 is a drawing showing examples of voltage waveforms during operation time periods of the pixel circuit of the exemplary embodiment.

Operation of the pixel circuit 30 of the exemplary embodiment will be described hereinafter. FIG. 3 is a drawing showing examples of voltage waveforms during the operation time periods of the pixel circuit 30 of the exemplary embodiment. Vs is the source voltage of the driving transistor 36, and Vgs is the voltage between the gate and the source of the driving transistor 36.

The time periods T1 through T4 shown in FIG. 3 are time periods that show one display time period of the pixel circuit 30. The time period before T1 of FIG. 3 is the previous display time period. Accordingly, in this previous display time period, the voltage value that is applied to the Data line 18, the source voltage Vs of the driving transistor 36, and the voltage Vgs between the gate and the source of the driving transistor 36, are voltages corresponding to the previous display time period. Here, the voltage ranges thereof are shown by mesh shading without specifying voltage values thereof in particular.

FIG. 4 through FIG. 7 are drawings schematically showing the on/off state of the selection gate connecting switch 32 and the flow of current in the respective operation time periods that will be described hereinafter.

Generally, the programming operation that sets the voltage at the retention capacitor 34 is performed in units of one row, and is performed in the same way in the exemplary embodiment as well.

Figure 5:
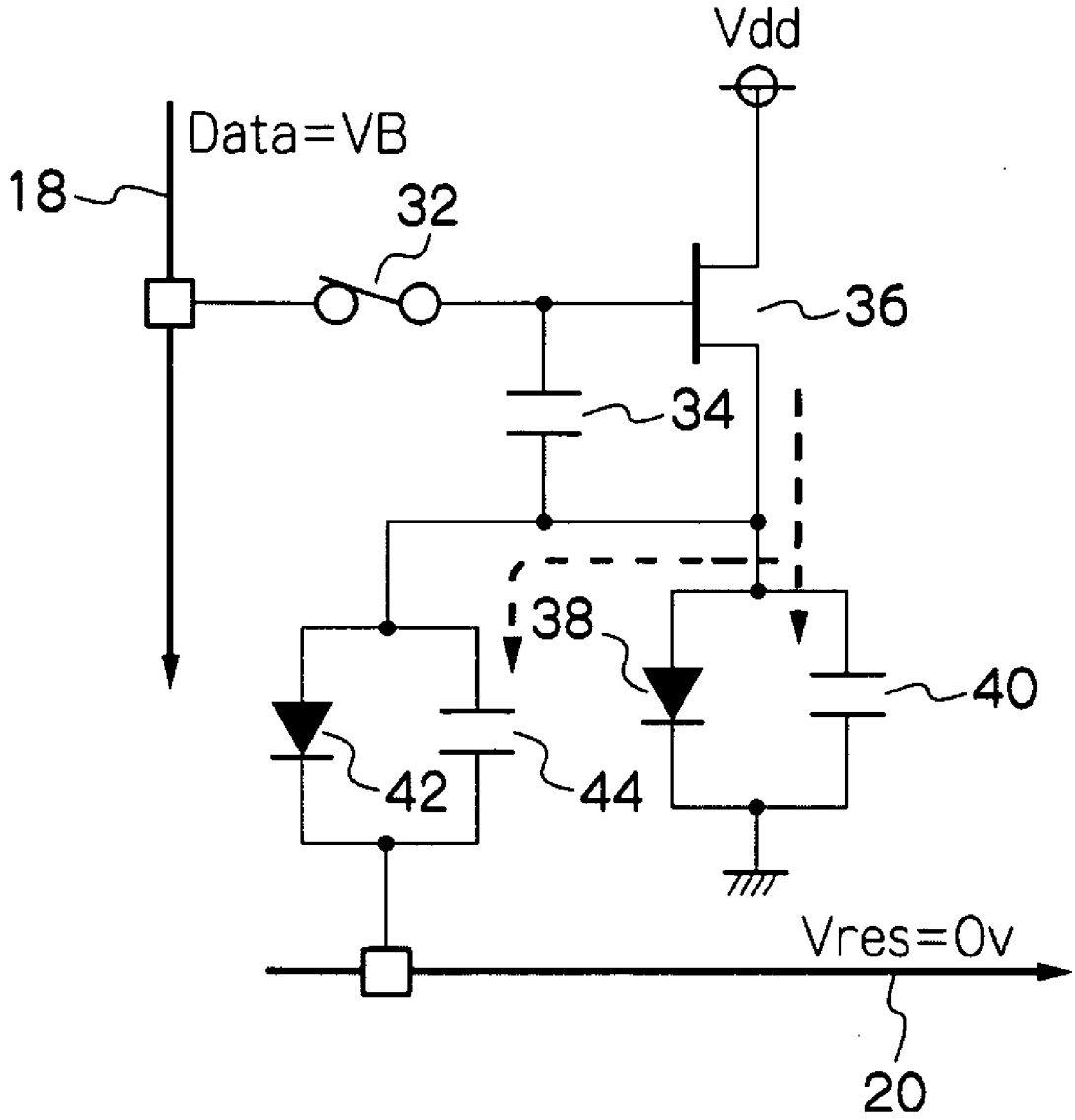
FIG. 5 is a drawing schematically showing the on/off state of the selection gate connecting switch and the flow of current during a threshold voltage detecting operation.

In time period T1 shown in FIG. 3, resetting operation is performed. In the resetting operation time period T1, the Scan signal is made to be H level by the scan driver 12. Due thereto, as shown in FIG. 5, the selection gate connecting switch 32 turns on, and the gate of the driving transistor 36 is connected to the Data line 18.

In this state, the voltage VB is provided as the Data signal to the Data line 18 by the data driver 14. The voltage VB is thereby supplied to the gate of the driving transistor 36.

Further, voltage VA is provided as reset voltage to the Vres line 20 by the reset driver 22. The voltage VA is thereby supplied to the discharging OLED 42.

Here, if VA<0, the parasitic capacitance 40 of the light emission OLED 38 is discharged to the Vres line 20 via the discharging OLED 42, and initial voltage Vs0 of the source voltage Vs of the driving transistor 36 is initialized to $$Vs0=VA+Vf0.$$

Figure 8:
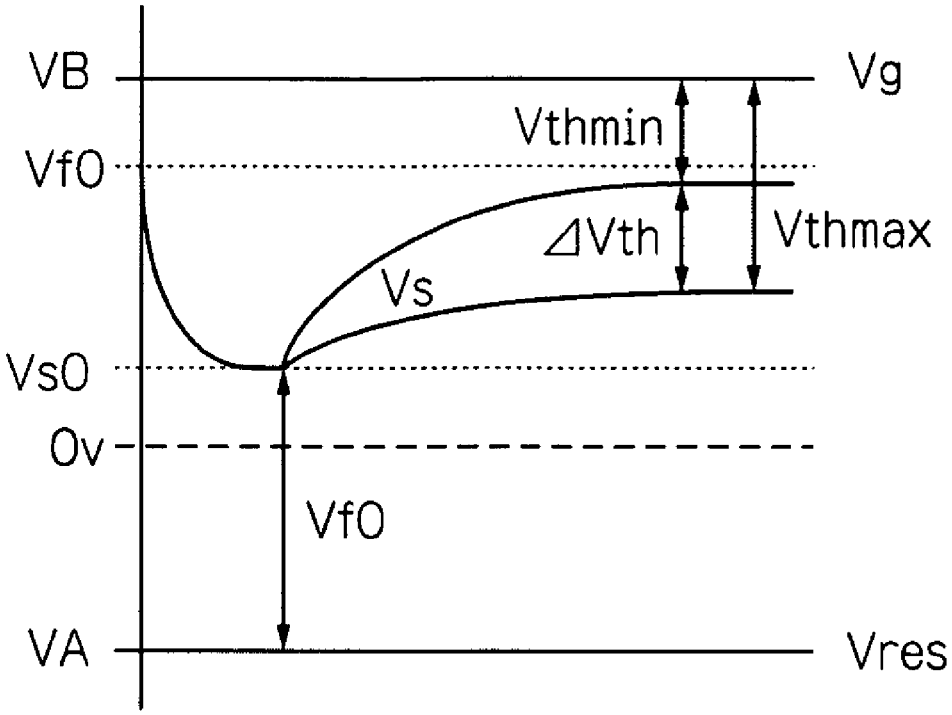
FIG. 8 is a drawing showing the relationship between voltage VA, voltage VB and source voltage Vs.

The relationships between the voltage VA, the voltage VB and the source voltage Vs will be explained with reference to FIG. 8. Given that the correction range of the threshold voltage Vth of the driving transistor 36 is Vthmin (lower limit value) to Vthmax (upper limit value), in order to cause some of the current Id to flow to the driving transistor 36, and the current Id to flow in the direction of the Vres line 20 (refer to the dotted line of FIG. 4), the voltage VB that is provided to the gate of the driving transistor 36 must be voltage that satisfies the condition $$VB>Vs0+Vth\max.$$

Further, given that the difference between Vthmin and Vthmax is ΔVth, a condition of the initial voltage Vs0 of the source voltage Vs will be $$Vs0<Vf0-\Delta Vth.$$

The threshold voltage Vth detection operation of the driving transistor 36 that will be described later, will be the operations that the parasitic capacitance 40 of the light emission OLED 38 and the parasitic capacitance 44 of the discharging OLED 42 are charged and the source voltage Vs is raised, and finally, Vth is detected. At this time, if the source voltage Vs becomes higher than the light-emitting threshold voltage Vf0 of the light emission OLED 38 and the discharging OLED 42, the light emission OLED 38 and the discharging OLED 42 emit light. Therefore, the source voltage Vs must be lower than Vf0. Accordingly, the condition of the initial value Vs0 of the source voltage Vs will be a voltage that is lower than the light-emitting voltage threshold value Vf0 by the difference ΔVth between Vthmin (the lower limit value) and Vthmax (the upper limit value).

Note that, as described above, because Vs0=VA+Vf0, $$VA+Vf0<Vf0-\Delta Vth.$$

Accordingly, the voltage VA is set to $$VA<-\Delta Vth.$$

Figure 4:
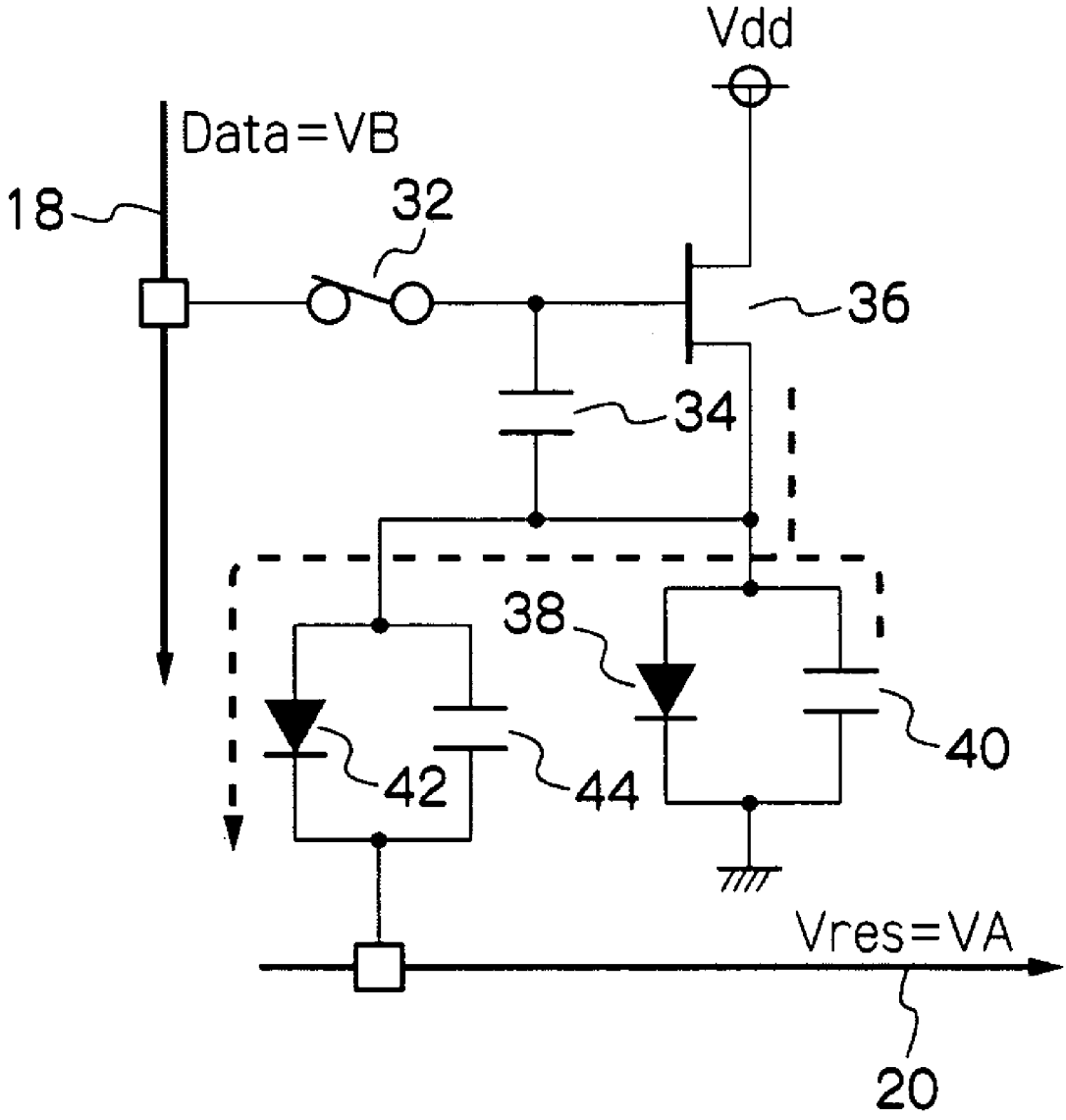
FIG. 4 is a drawing schematically showing the on/off state of a selection gate connecting switch and the flow of current during a resetting operation.

Due to the above-described operation, current flows within the pixel circuit 30 in the direction shown by the dotted line of FIG. 4, and the parasitic capacitance 40 is discharged.

Here, the light-emitting threshold voltages of the light emission OLED 38 and the discharging OLED 42 are made to be the common Vf0. However, in cases in which the respective light-emitting threshold voltages are not common, the initial voltage Vs0 of the source voltage Vs may be computed using the smaller light-emitting threshold voltage value, and the voltage VA may be computed using the larger light-emitting threshold voltage value.

In time period T2 shown in FIG. 3, threshold voltage detecting operation is performed. When time period T1 ends and time period T2 is started, the potential of the Vres line 20 is set by the reset driver 22 from the voltage VA to the cathode potential (generally GND) of the discharging OLED 42.

Due to the change in voltage of the Vres line 20, the source voltage Vs of the driving transistor 36 rises from the initial value Vs0 to Vs1.

Considering the preconditions that the capacity of the retention capacitor 34 is Cs, the capacity of the parasitic capacitance 40 of the light emission OLED 38 is Cd1, the capacity of the parasitic capacitance 44 of the discharging OLED 42 is Cd2, and Cs is sufficiently smaller than Cd1, the source voltage Vs will be the divided voltage of the parasitic capacitance 40 and the parasitic capacitance 44, and therefore, $$Vs1=Vs0-VA*Cd2/(Cd1+Cd2).$$

Here, for example, if Cd1=Cd2, then $$Vs1=Vs0-VA/2.$$

If the surface area of the discharging OLED 42 is sufficiently small with respect to the surface area of the light emission OLED 38, Cd2<<Cd1, and Vs1 can be considered to be substantially Vs0. However, if it is not the case that Cd2<<Cd1, it should be noted that the voltage VA, that is set at the Vres line 20 during the above-described reset time period T1, should not be set to VA<−ΔVth, but rather, should be set to $$VA<-\Delta Vth*(Cd1+Cd2)/Cd1.$$

Here, because the voltage Vgs between the gate and the source is $$Vgs=Vg-Vs=VB-Vs1>Vth,$$

the current Id flows to the driving transistor 36 (refer to the dotted line of FIG. 5). The parasitic capacitance 40 and the parasitic capacitance 44 are charged by the current Id, and the source voltage Vs of the driving transistor 36 rises.

Further, because the gate voltage Vg of the driving transistor 36 is fixed voltage of VB, due to the source voltage Vs rising, the voltage Vgs between the gate and the source gradually decreases, and the current Id decreases. In this process, the voltage Vgs between the gate and the source of the driving transistor 36 gradually approaches the threshold voltage Vth. Then, when a preset charging time period elapses, the operation of detecting the threshold voltage Vth is stopped.

At this time, the gate voltage Vg is VB, and the source voltage Vs is VB−Vth. Accordingly, the voltage VB that is applied to the gate voltage Vg is set to $$VB<Vf0+Vth\min$$

in order to make the source voltage Vs be less than or equal to the light emission threshold voltage Vf0 so that the light emission OLED 38 and the discharging OLED 42 are not made to emit light during time period T2.

Here, the light emission threshold voltage of the light emission OLED 38 and the discharging OLED 42 are made to be a common Vf0. However, if they are not common, the voltage VB may be computed using the smaller light emission threshold voltage value.

Figure 6:
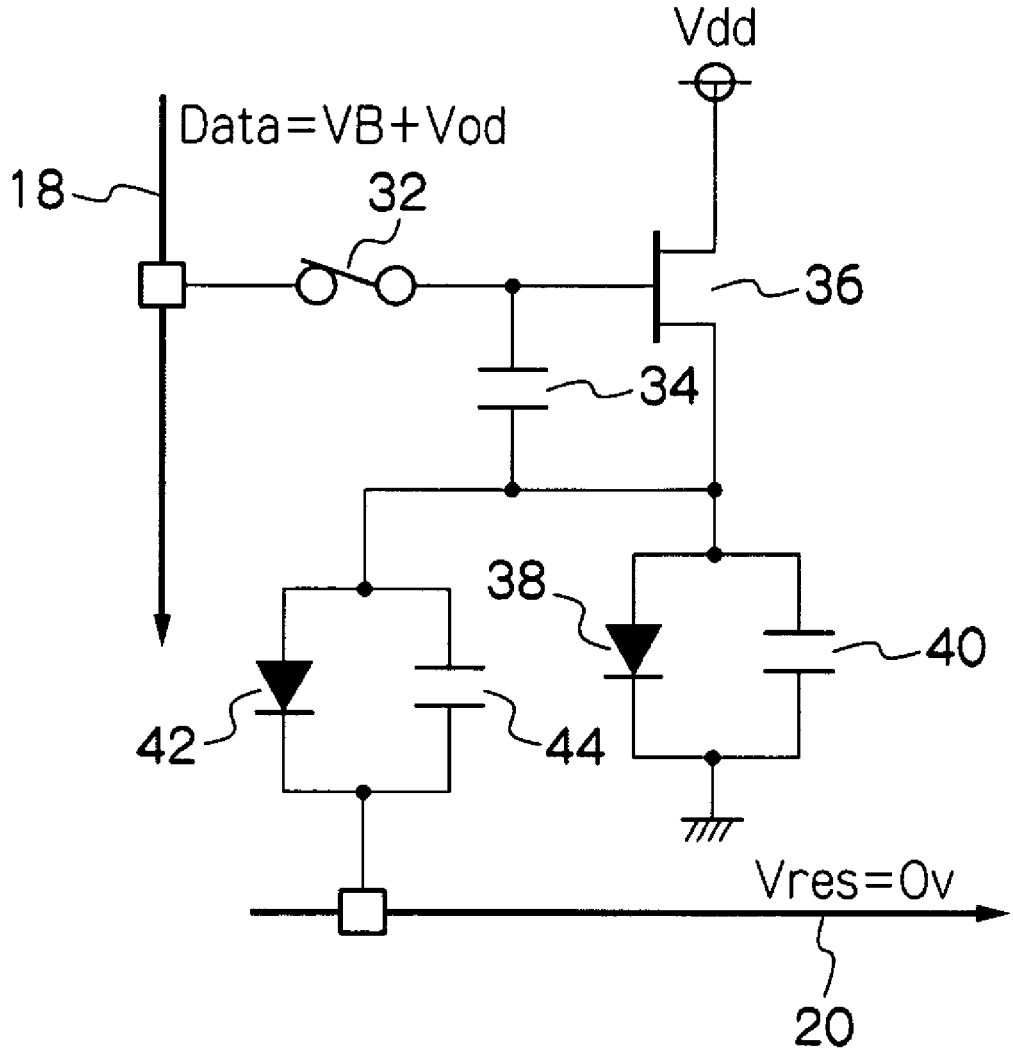
FIG. 6 is a drawing schematically showing the on/off state of the selection gate connecting switch and the flow of current during a programming operation.

In time period T3 shown in FIG. 3, so-called programming operation is performed that causes the voltage, that is for making current flow to the driving transistor 36, to be held at the retention capacitor 34. In order to make current flow to the driving transistor 36, voltage (overdrive voltage Vod: Vod=Vgs−Vth) that is in further excess of the threshold voltage Vth must be applied. Thus, at the time of the start of the programming time period T3, as shown in FIG. 6, the Data signal voltage of the Data line 18 is stepped-up from VB to VB+Vod. Accordingly, the gate voltage Vg of the driving transistor 36 becomes VB+Vod.

Further, because the source voltage Vs is the divided voltage of the retention capacitor 34, the parasitic capacitance 40 and the parasitic capacitance 44, the source voltage Vs of the driving transistor 36 at this time will be $$Vs=(VB-Vth)+Vod*Cs/(Cd1+Cd2+Cs).$$

At this time, if the capacity Cs of the retention capacitor 34 is sufficiently smaller than the sum total Cd1+Cd2 of the capacity of the parasitic capacitance 40 and the parasitic capacitance 44, the source voltage Vs is substantially equal to "VB−Vth". Therefore, the voltage Vgs between the gate and the source of the driving transistor 36 is substantially $$Vgs=Vg-Vs=(VB+Vod)-(VB-Vth)=Vth+Vod.$$

The voltage, that is obtained by adding the overdrive voltage Vod to the threshold voltage Vth detected substantially in the threshold voltage detecting operation time period T2, is set at the retention capacitor 34 that is positioned between the gate and the source of the driving transistor 36. The voltage that is set here is called the program voltage.

Further, in accordance with the TFT current formula, the current Id expressed as below flows-out to the driving transistor 36:

$$Id=\mu*Cox*(W/L)*(Vgs-Vth)^2=\mu*Cox*(W/L)*Vod^2$$

where μ is the mobility, Cox is the electrostatic capacity per unit surface area of the gate insulating film, W is the channel width and L is the channel length.

After completion of the above-described programming operation (i.e., in the latter half of time period T3 shown in FIG. 3), correction operation of the mobility μ is performed, and the program voltage is corrected.

Concretely, for a set time (=Tx) from the completion of the above-described programming operation, the Scan signal is maintained at H level, and the selection gate connecting switch 32 is maintained in the on state.

During this time, the current Id that corresponds to the programmed voltage Vod flows to the driving transistor 36. The current Id charges the parasitic capacitance 40 and the parasitic capacitance 44, and as shown in FIG. 3, the source voltage Vs of the driving transistor 36 rises again. Given that this voltage that rises again is ΔV, ΔV can be expressed by the following formula.

$$\Delta V=Tx*Id/(Cd1+Cd2)$$

Further, as described above, the saturated region current formula of a TFT is expressed as $$Id=\mu*Cox*(W/L)*(Vgs-Vth)^2,$$

and because the threshold voltage Vth is already corrected in time period T2, $$Id=\mu*Cox*(W/L)*Vod^2.$$

Accordingly, ΔV becomes a voltage that corresponds to μ*Cox*(W/L) of each driving transistor 36, and voltage "Vth+Vod−ΔV", that is obtained by subtracting ΔV from the voltage Vgs between the gate and the source (as described above, Vgs=Vth+Vod), is held at the voltage Vcs of the retention capacitor 34. Due thereto, the program voltage is corrected, and the μ deviations of the driving transistors 36 of the respective pixels are cancelled.

This μ correction operation is effective in cases in which the μ deviation of a TFT at an LPTS or the like becomes a cause of unevenness in the display luminance, and is not necessary for TFTs at which the μ deviation is small such as a-Si (amorphous silicon) or inorganic oxide films or the like.

In time period T4 shown in FIG. 3, light-emitting operation is performed. Note that, in the light-emitting time period T4 of FIG. 3, the potential of the Data line 18 does not affect the light-emitting operation in the current display time period. Therefore, here, the voltage range thereof is shown by mesh shading without specifying the Data signal voltage in particular.

Figure 7:
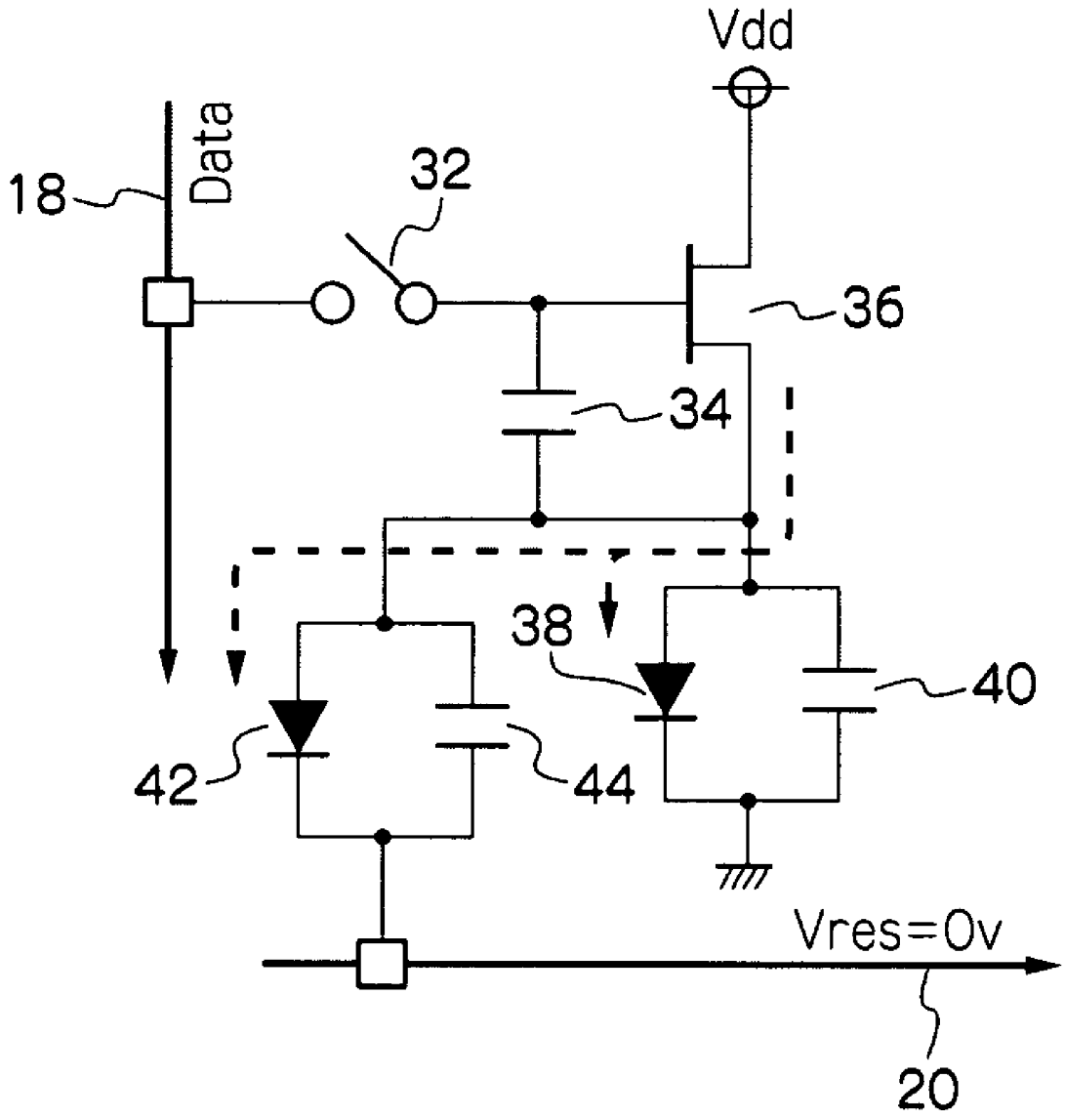
FIG. 7 is a drawing schematically showing the on/off state of the selection gate connecting switch and the flow of current during a light-emitting operation.

In the light-emitting time period T4, the Scan signal is made to be L level by the scan driver 12, and as shown in FIG. 7, the selection gate connecting switch 32 turns off. Due thereto, the pixel circuit 30 and the Data line 18 are electrically disconnected.

Further, the voltages at both ends of the retention capacitor 34 remain held, and, due to the current Id that flows to the driving transistor 36, the source voltage Vs rises. Because the voltage Vgs between the gate and the source of the driving transistor 36 remains retention the program voltage (Vod+Vth), eventually, the source voltage Vs exceeds the light-emitting threshold voltage Vf0 of the light emission OLED 38 and the discharging OLED 42, and OLED light-emitting operation at a constant current is performed.

As described above, because the discharging OLED 42 is provided in addition to the light emission OLED 38, the parasitic capacitance 40 is actively discharged rather than naturally discharged, and the discharging time period can be shortened. Further, the light-emitting element OLED is used as a switch, without providing a transistor switch for OLED parasitic capacitance discharge. Therefore, the discharging OLED 42 that is used as a switch can be manufactured in the same manufacturing process as the light emission OLED 38, and an increase in costs due to a decrease in yield, and a decrease in the lifespan due to a decrease in the OLED aperture ratio, can be prevented.

Note that, in the exemplary embodiment, a single OLED is divided, and one portion thereof is used as the light emission OLED 38 whereas the other portion thereof is used as the discharging OLED 42. However, the discharging OLED 42 may be provided as a separate diode element. For example, a non-light-emitting diode element or an OLED having a low light emission threshold voltage may be used instead of the above-described discharging OLED 42.

When the discharging OLED 42 and the light emission OLED 38 are the same structure, when the discharging OLED 42 is discharged, there are cases in which the discharging OLED 42 may emit light instantaneously due to the discharge current, and there is the possibility that it will adversely affect the contrast ratio of the display device.

Thus, light emission at the time of discharging can be prevented by using a diode element that is structured of a material that has a low light-emitting efficiency or of a material that does not perform a light-emitting operation.

By using an OLED whose light-emitting threshold voltage is made to be low, a rise in the source voltage Vs at the time of canceling the resetting is suppressed, and the threshold voltage Vth correction range can be broadened. In addition, the voltage VA that is near 0 V can be employed, and the amount of electric power consumption at the display device may be reduce. However, in this case, a high voltage setting that corresponds to the light-emitting threshold voltage Vf0 of the light emission OLED 38, rather than the cathode voltage of the OLED, is needed for the potential of the Vres line 20 after resetting is canceled.

Even when such diode elements are used, a decrease in yield and the like can be prevented as compared with a case in which a transistor is provided as a reset switch. When such a diode element is used, setting of the program voltage to the driving transistor should be determined by taking into consideration a condition that the diode element does not contribute to luminance when current flows in the light-emitting operation of T4.

The above exemplary embodiment describes that it is preferable to make the surface area of the discharging OLED 42 sufficiently small with respect to the surface area of the light emission OLED 38, and to design the OLEDs such that Cd2<<Cd1. However, when the discharging OLED 42 is small, the discharge current also decreases, and the time required for the resetting operation becomes long. Accordingly, in order to promote discharging, at the time of the resetting operation, a lower voltage VA (a large negative voltage) must be set at the Vres line 20, and in that case the rise in the source voltage Vs at the time of the start of the programming operation (the time of the canceling of resetting) becomes large.

Figure 9:
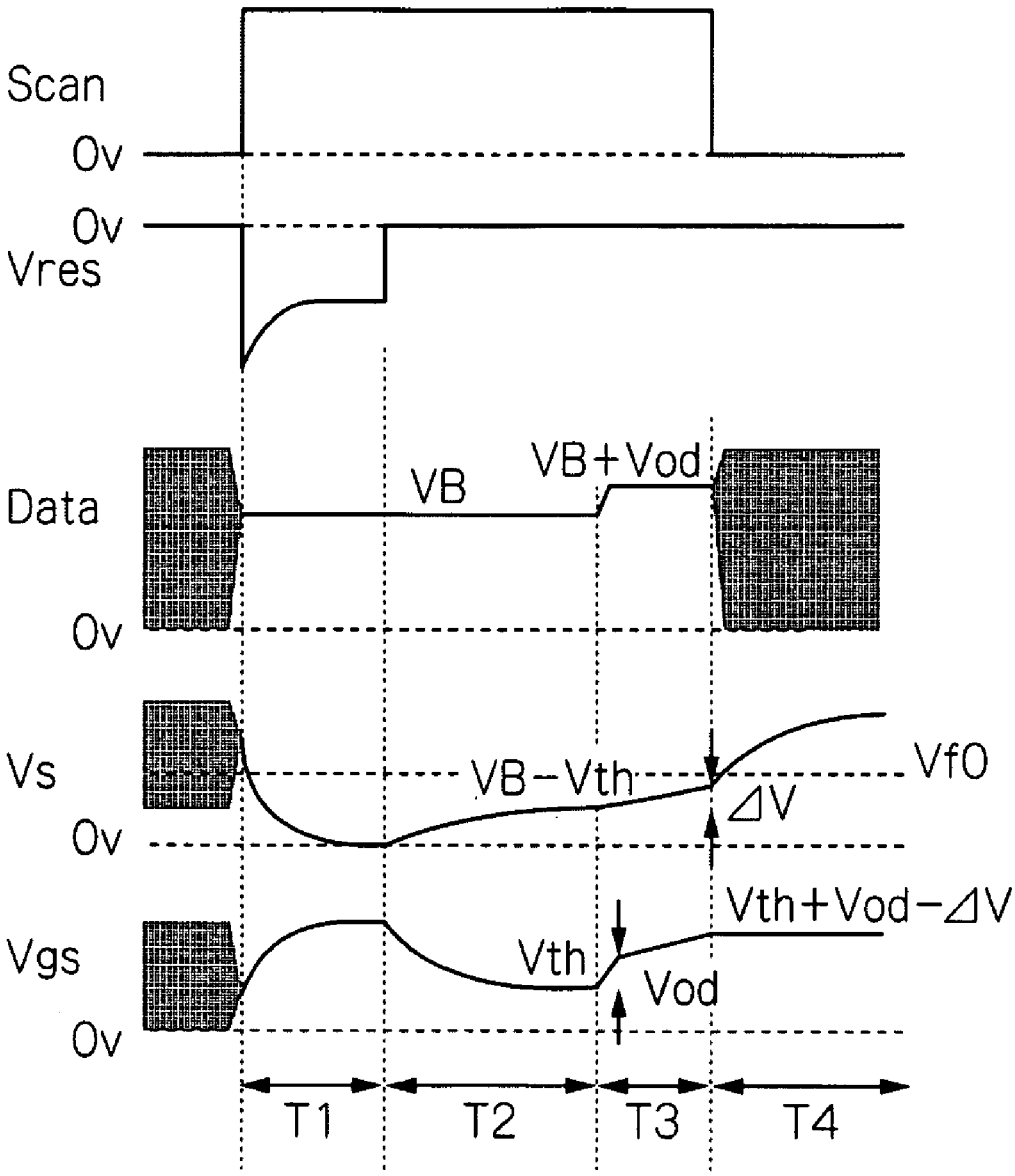
FIG. 9 is a drawing showing modified examples of voltage waveforms during the operation time periods of the pixel circuit of the exemplary embodiment.

Thus, the voltage VA that is set at the Vres line 20 may be a variable voltage rather than a fixed voltage, so that the source voltage Vs to be as small as possible immediately before the programming operation. Specifically, as shown in the voltage waveform of the Vres line 20 of FIG. 9, in the time period T1, the reset driver 22 first starts the resetting operation at a low voltage (a high negative voltage), and, as time passes, raises the potential, and, at the time of the canceling of resetting, makes the voltage be a voltage (a small negative voltage) that is near to the VA limiting value (VA<−ΔVth). Due thereto, both a promoting of discharging and a suppression of rising of Vs at the time of canceling of resetting can be achieved.

In the exemplary embodiment, a single OLED is divided at a predetermined division surface area ratio, and one portion thereof is used as the light emission OLED 38 and the other portion is used as the discharging OLED 42. This division surface area ratio may be set such that the parasitic capacitances 40 of the light emission OLEDs 38 have common (substantially same) capacity at the respective pixels of RGB, and the discharging OLEDs 42 may be excluded from the load for charging at the time of threshold voltage Vth detection and at the time of μ correction.

As described above, generally, an active matrix system organic EL display device is structured such that pixel columns of each color, in which pixels per color of RGB are arranged in the column direction (the direction in which the Data lines 18 extend), are disposed in the order of, for example, RGBRGB . . . in the row direction (the direction in which the Scan lines 16 extend). Further, the parasitic capacitance of an OLED is determined by the relative permittivity (dielectric constant) and the film thickness of the organic light-emitting material that structures the OLED, and the relative permittivity and the film thickness also differ in accordance with the color (RGB) of the OLED. Therefore, even if OLEDs have the same surface area, the parasitic capacitances thereof differ per color of the OLED. Accordingly, by providing the light emission OLEDs 38 and the discharging OLEDs 42 by setting the division surface area ratio such that the capacitances will be common values for RGB, the RGB deviations can be corrected.

Figure 10:
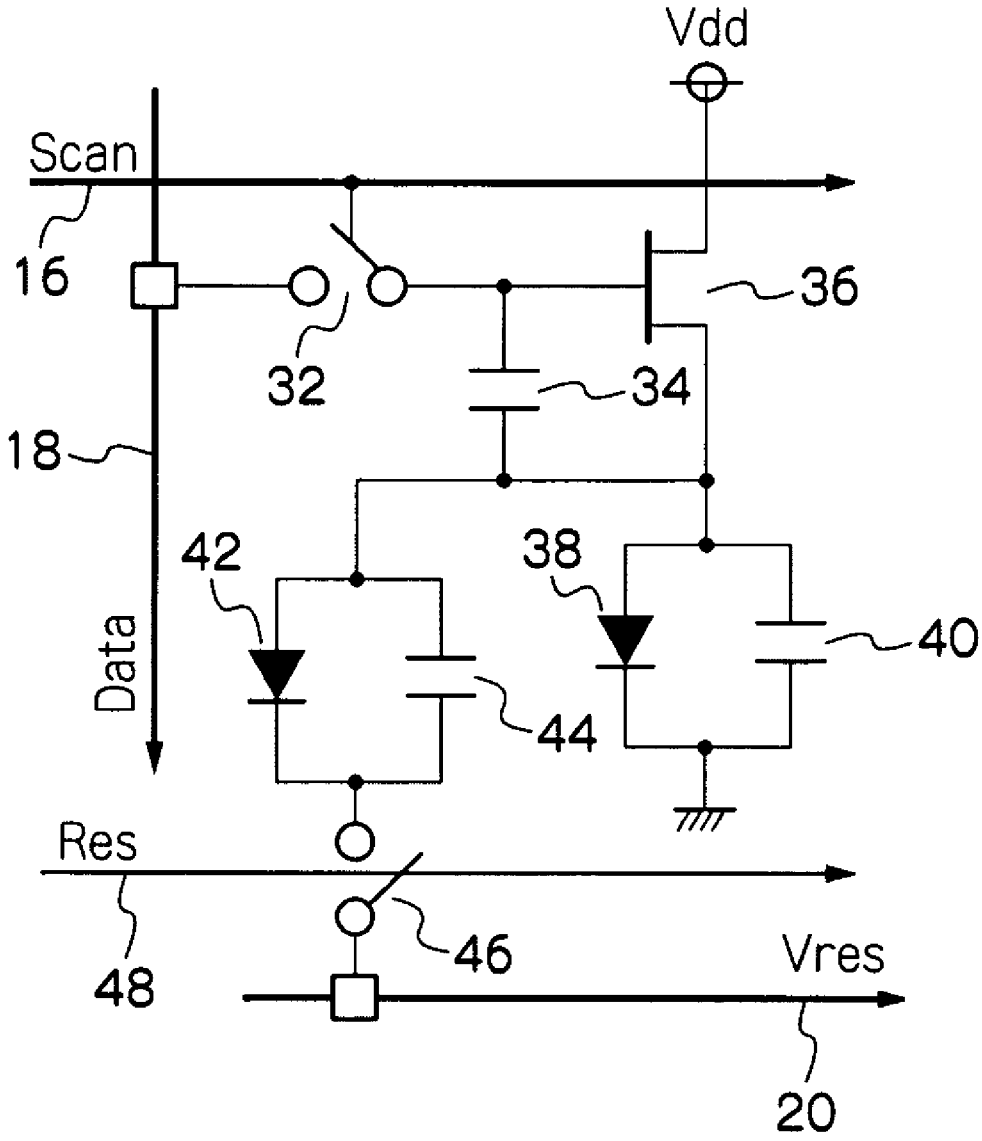
FIG. 10 is a drawing showing a modified example of the pixel circuit.

Further, in order to exclude the discharging OLED 42 from the load for charging at times of threshold voltage Vth detection and at times of μ correction, for example, an OLED opening switch 46 can be added between the cathode of the discharging OLED 42 and the Vres line 20 as shown in FIG. 10. The OLED opening switch 46 may be formed from a thin film transistor, and the gate thereof is connected to a reset line 48. The OLED opening switch 46 turns on and off in accordance with control signals provided from the scan driver 12 via the reset line 48. Specifically, the OLED opening switch 46 is on during time periods T1 and T4. In time periods T2 and T3, the OLED opening switch 46 is off, and makes one end of the discharging OLED 42 be an open end. Control other than this is performed in the same way as in the above-described exemplary embodiment.

When utilizing a structure of FIG. 10, the OLED opening switch 46 needed to be provided separately. Therefore, the RGB deviations can be overcome, but the effect of preventing a decrease in yield and the effect of preventing a decrease in lifespan due to a decreased OLED aperture ratio may deteriorate. Thus, the OLED opening switch 46 may be omitted, and instead, a control such that the Vres line 20 is made to be an open line may be performed.

Specifically, at the start of T2 (the time of canceling the resetting), the voltage of the Vres line 20 is raised by the reset driver 22 from the voltage VA to a voltage that is near to the initial value Vs0 of the source voltage, i.e., is raised to a voltage within a predetermined range that is less than or equal to the initial value Vs0. Because the gate voltage Vs is fixed, the parasitic capacitance 44 of the discharging OLED 42 discharges, and the charges thereof substantially become 0. Thereafter, the Vres line 20 is electrically disconnected from the power supply voltage by the reset driver 22 (i.e., the Vres line 20 is set in a floating state in which the power supply voltage is not supplied thereto), and is made to be an open line in time periods T2 and T3.

Figure 11:
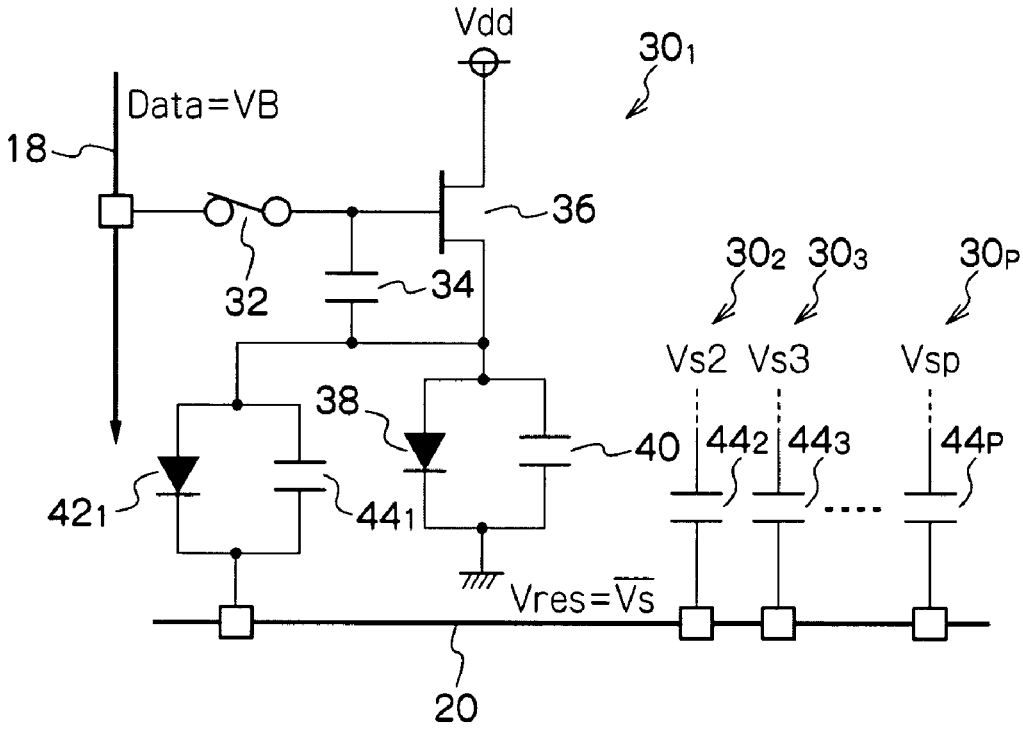
FIG. 11 is a drawing showing an equivalent circuit at a time of disconnecting a Vres line from power supply voltage and making it into an open line.
Figure 12:
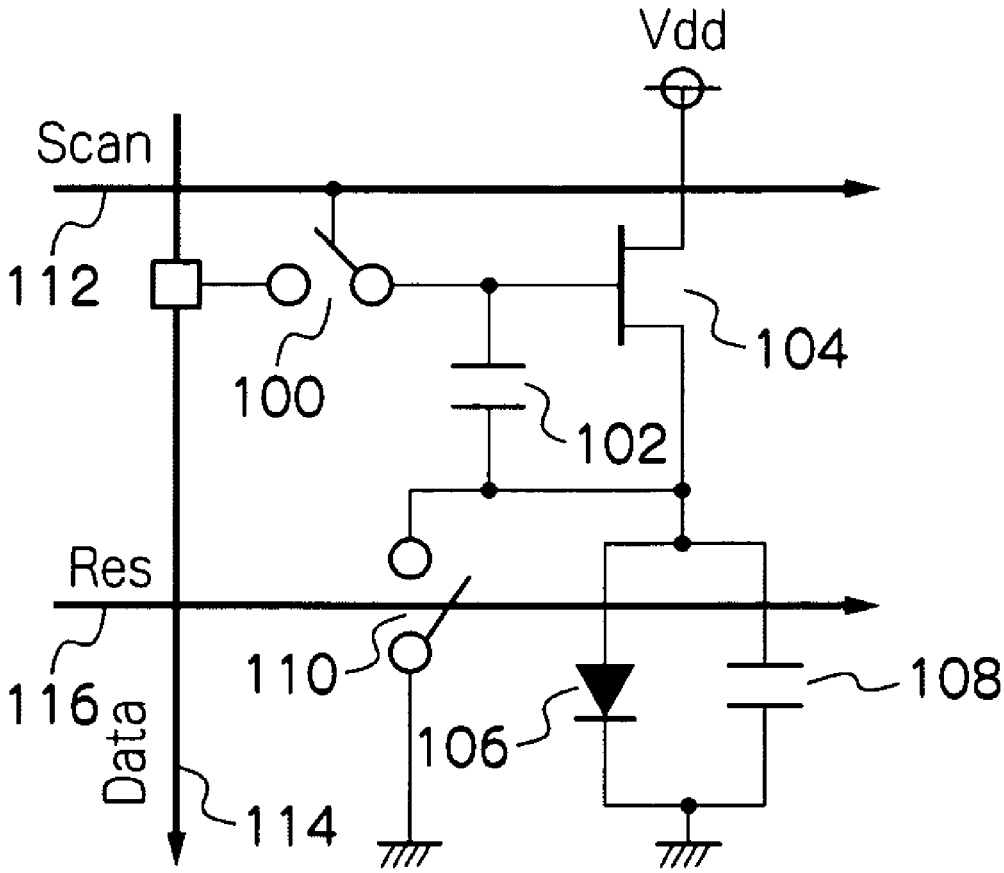
FIG. 12 PRIOR ART
FIG. 12 is a drawing showing a conventional pixel circuit structure.
Figure 13:
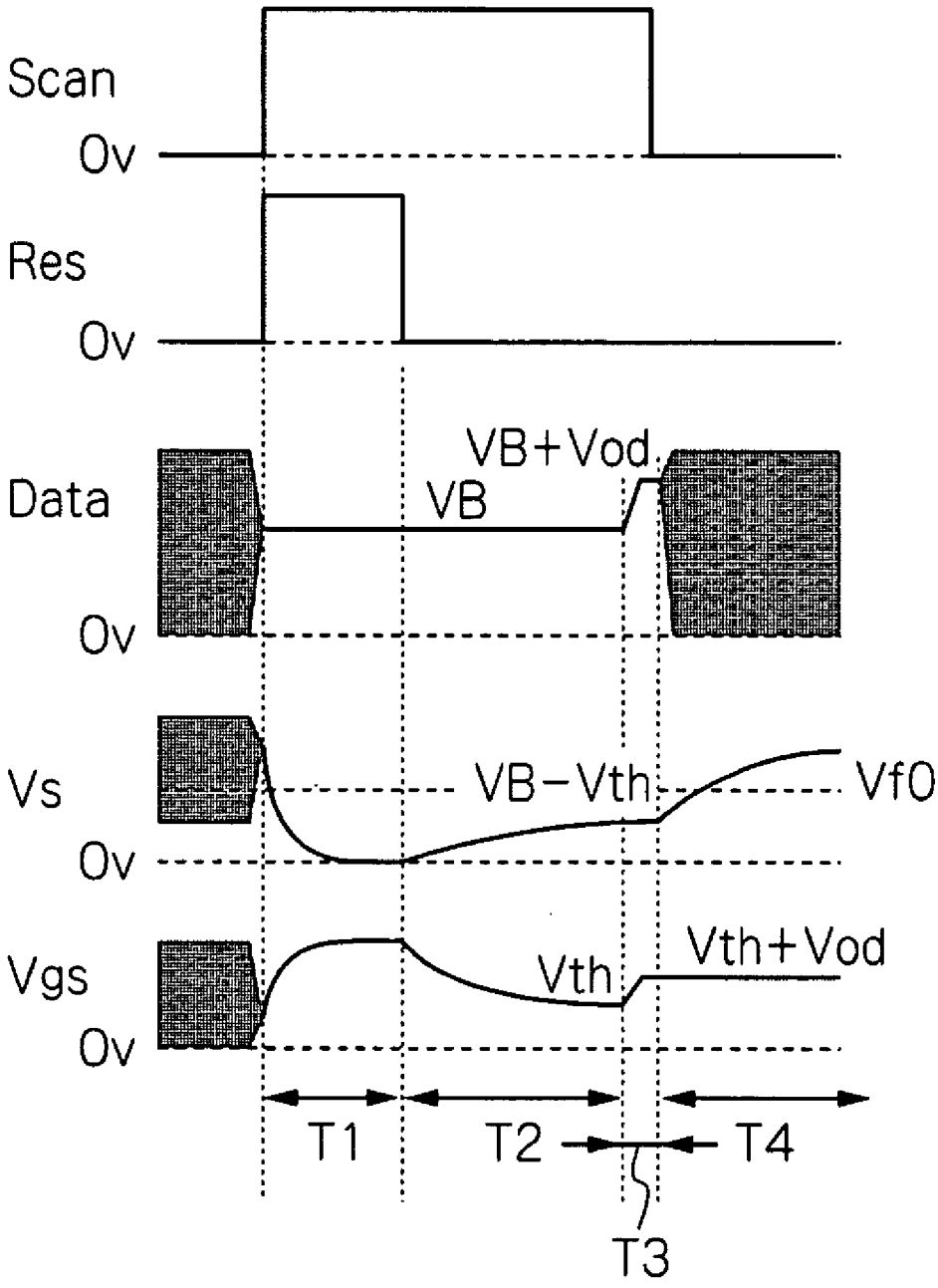
FIG. 13 PRIOR ART
FIG. 13 is a drawing showing examples of voltage waveforms during operation time periods of the conventional pixel circuit.
Figure 14:
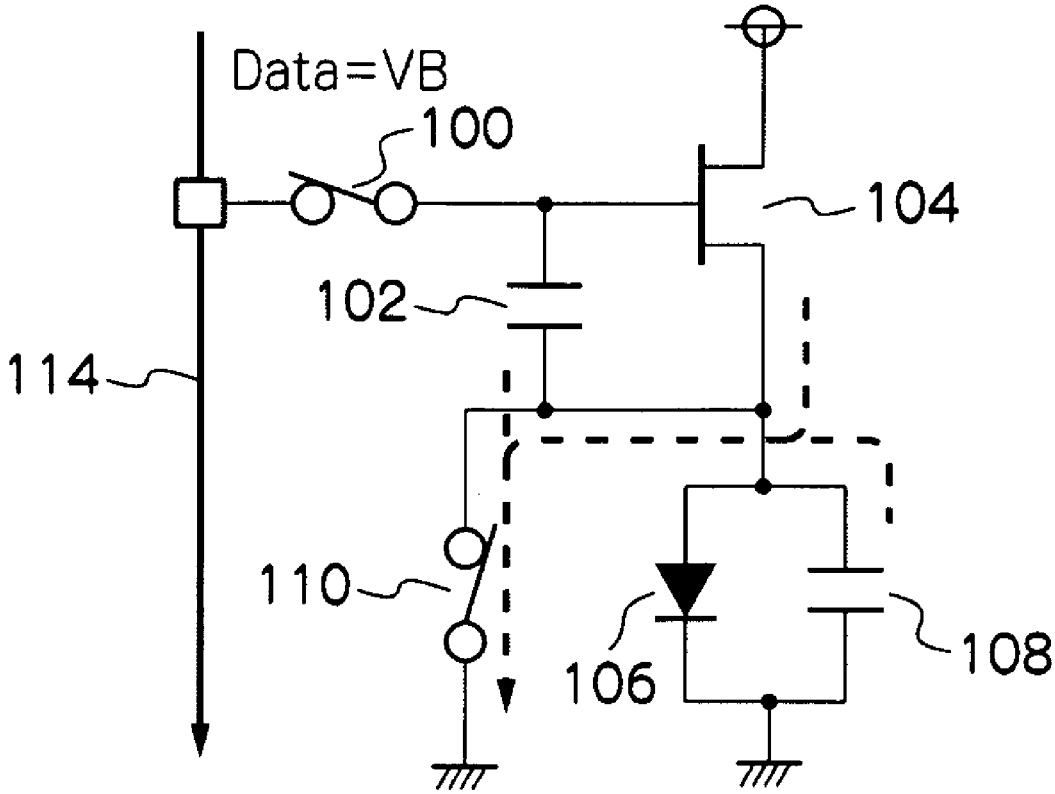
FIG. 14 PRIOR ART
FIG. 14 is a drawing schematically showing the on/off states of a selection gate connecting switch and a reset switch and the flow of current during a conventional resetting operation.
Figure 15:
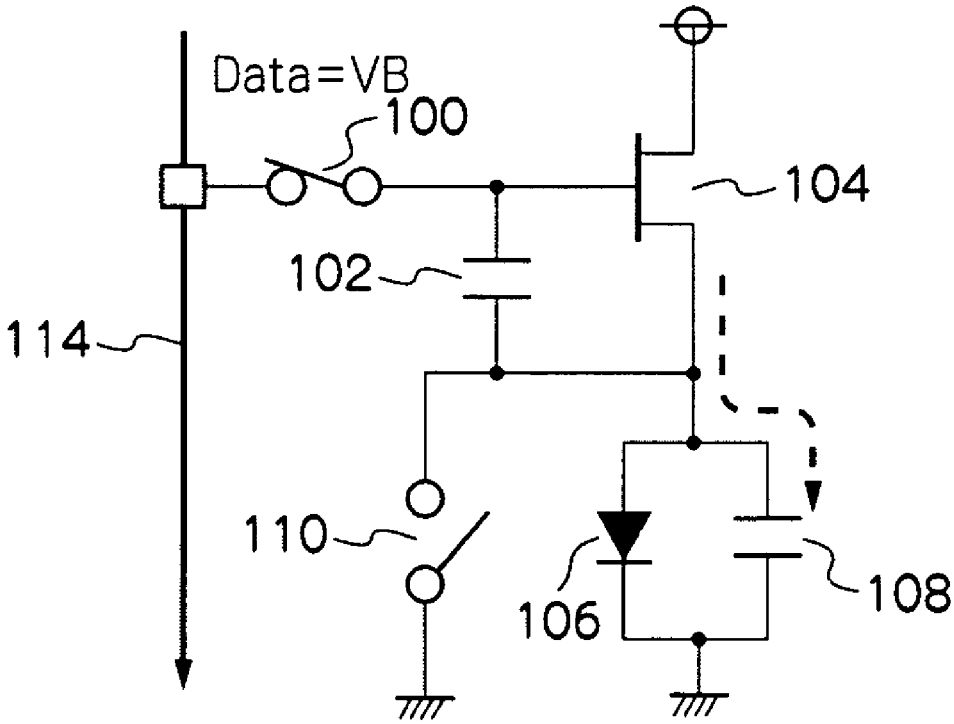
FIG. 15 PRIOR ART
FIG. 15 is a drawing schematically showing the on/off states of the selection gate connecting switch and the reset switch and the flow of current during a threshold voltage detecting operation.
Figure 16:
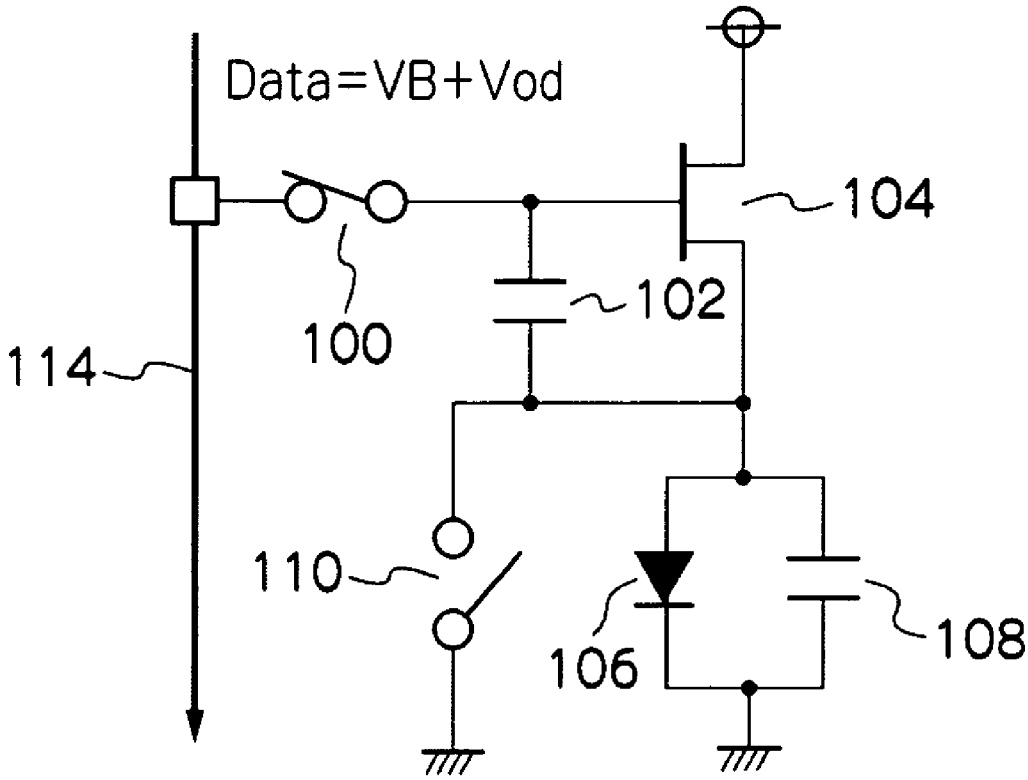
FIG. 16 PRIOR ART
FIG. 16 is a drawing schematically showing the on/off states of the selection gate connecting switch and the reset switch and the flow of current during a programming operation.
Figure 17:
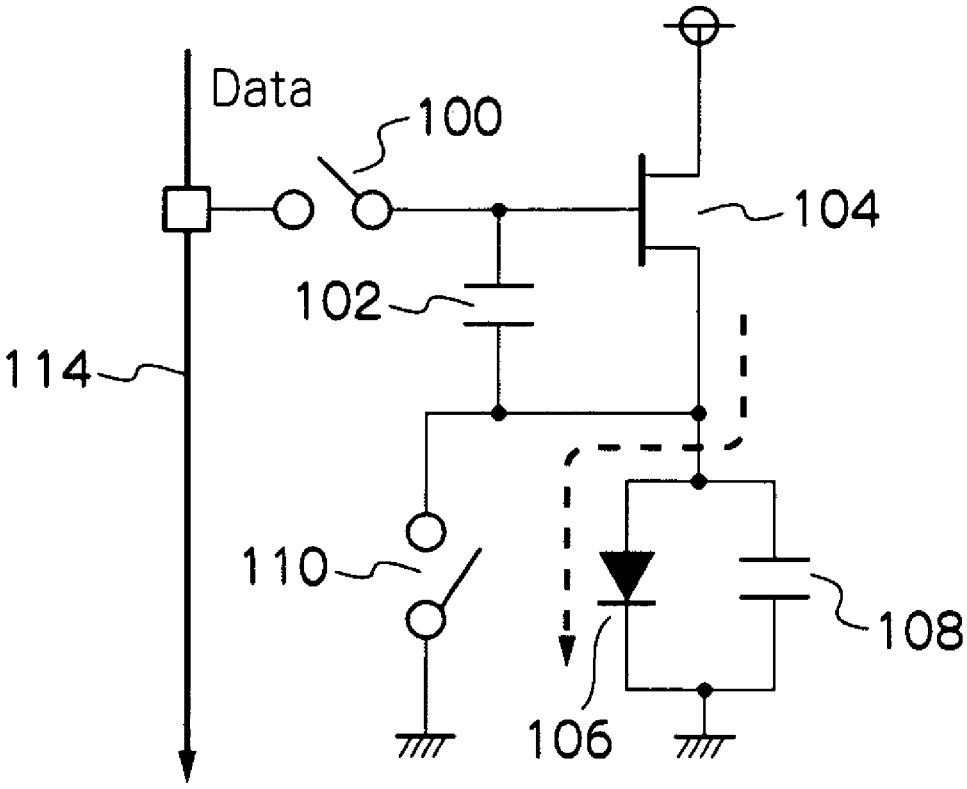
FIG. 17 PRIOR ART
FIG. 17 is a drawing schematically showing the on/off states of the selection gate connecting switch and the reset switch and the flow of current during a light-emitting operation.
Figure 18:
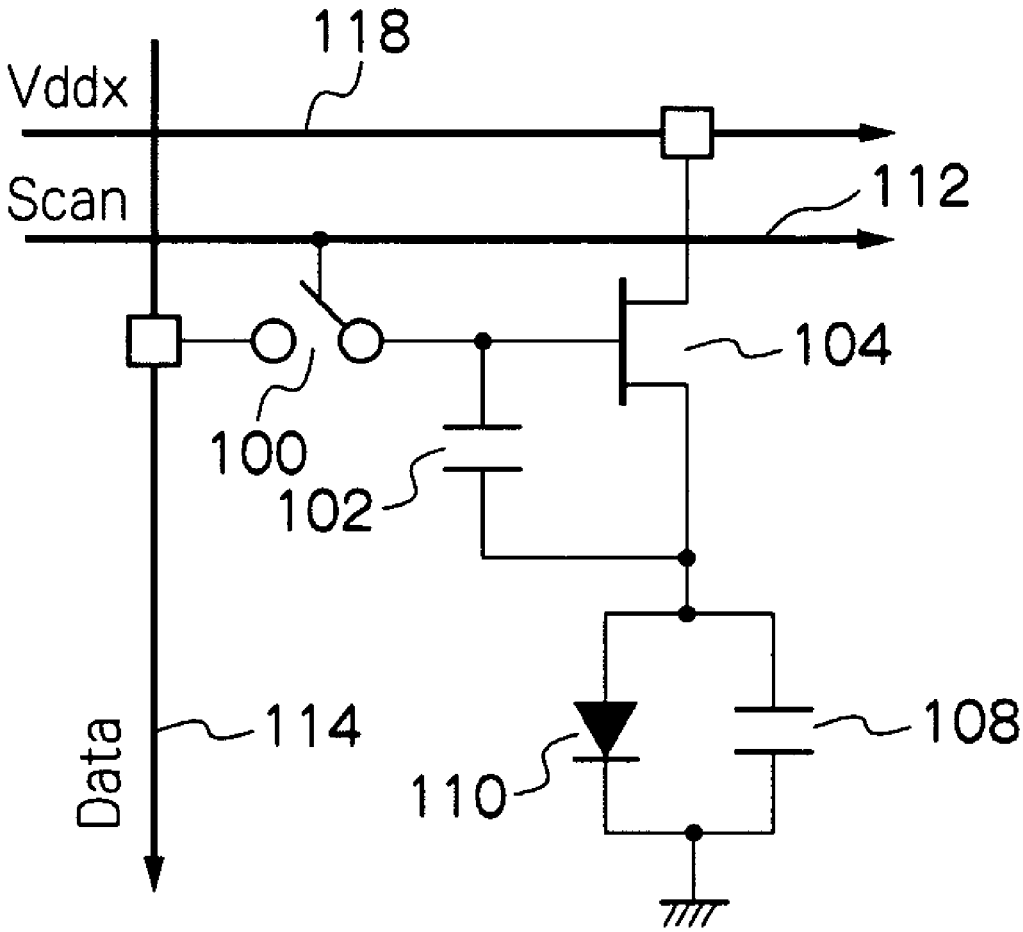
FIG. 18 PRIOR ART
FIG. 18 is a drawing showing a conventional pixel circuit structure that performs μ correction operation.
Figure 19:
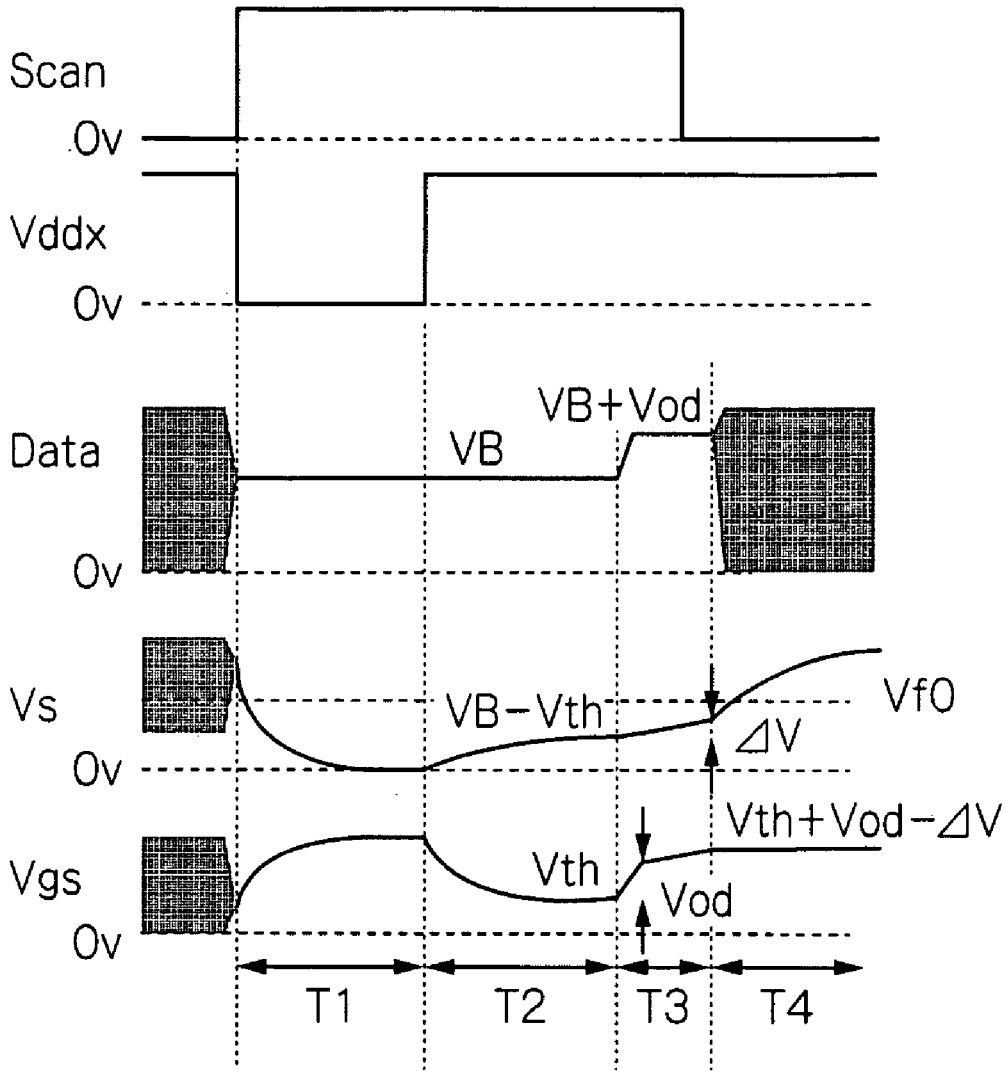
FIG. 19 PRIOR ART
FIG. 19 is a drawing showing examples of voltage waveforms during operation time periods of the conventional pixel circuit that performs μ correction operation.
Figure 20:
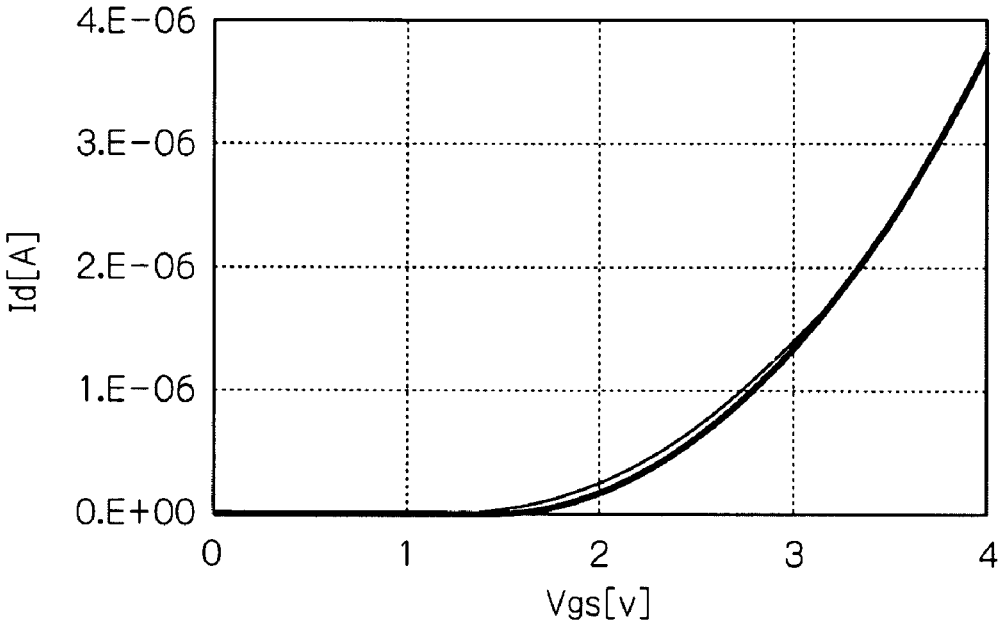
FIG. 20 RELATED ART
FIG. 20 is an example of a graph showing Vgs-Id characteristics of TFTs.
Figure 21:
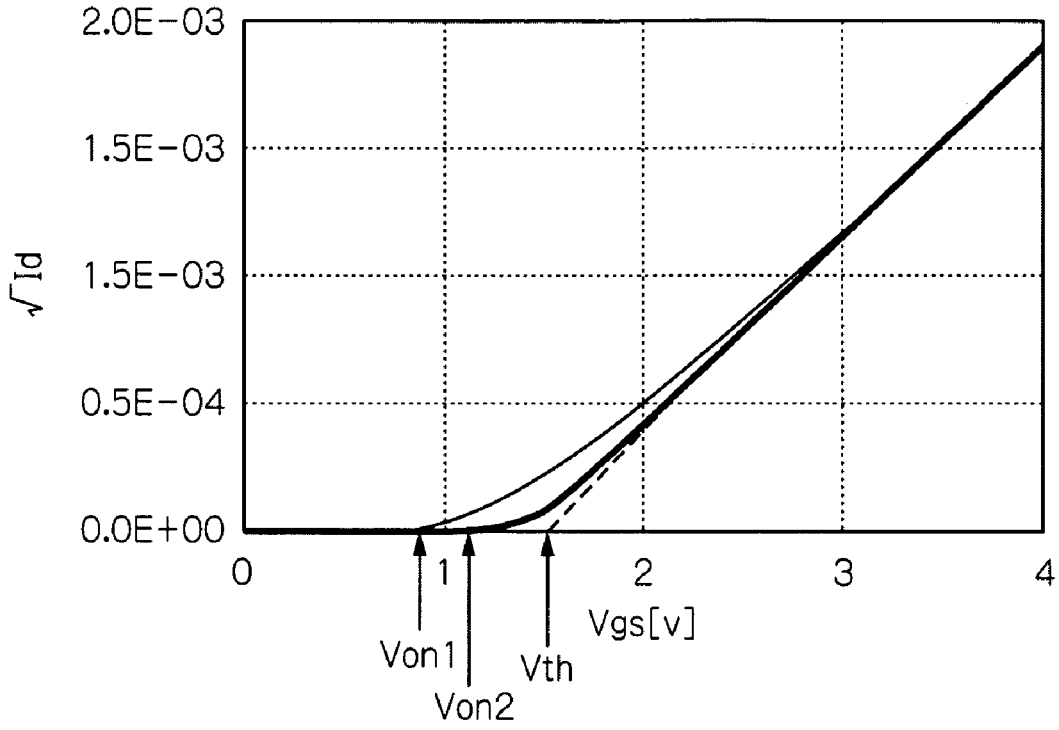
FIG. 21 RELATED ART
FIG. 21 is an example of a graph showing Vgs-√Id characteristics of TFTs.
Figure 22:
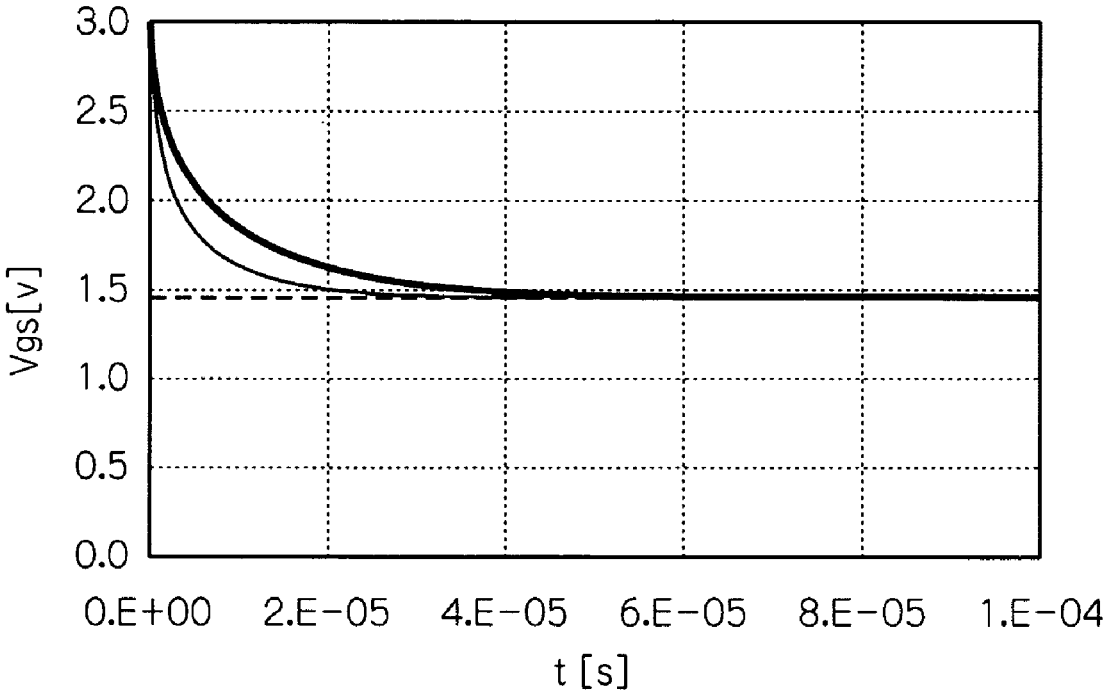
FIG. 22 RELATED ART
FIG. 22 is a graph showing examples of results of simulation of threshold voltage detection operation in cases in which a capacity Cd of a parasitic capacitance is 2 pF and 4 pF, at a TFT whose sub-threshold region current is small.
Figure 23:
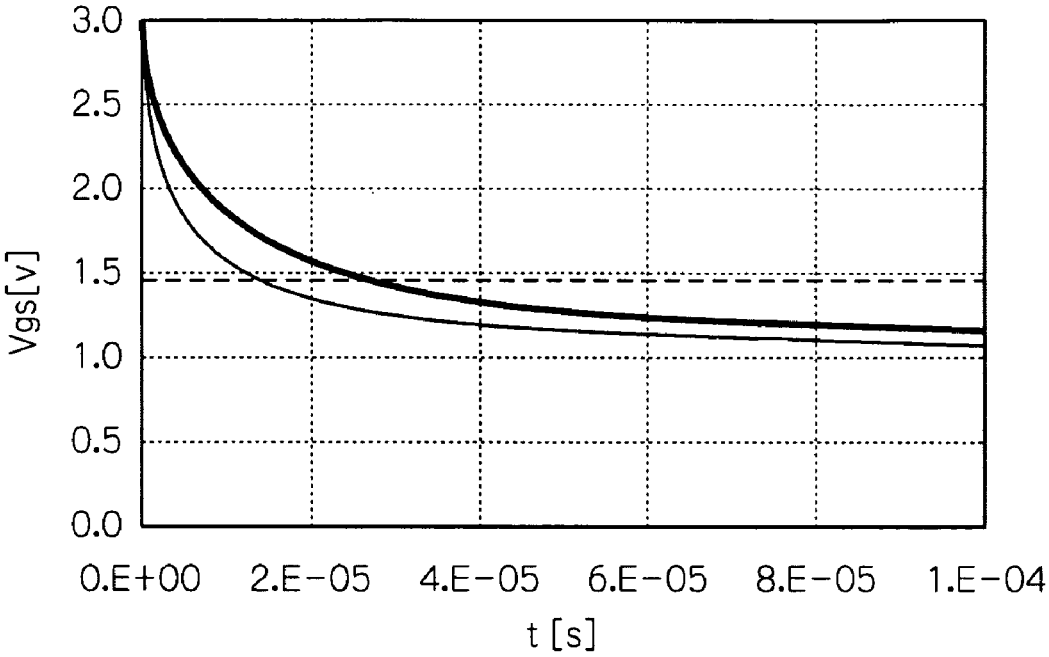
FIG. 23 RELATED ART
FIG. 23 is a graph showing examples of results of simulation of threshold voltage detection operation in cases in which a capacity Cd of a parasitic capacitance is 2 pF and 4 pF, at a TFT whose sub-threshold region current is large.
Figure 24:
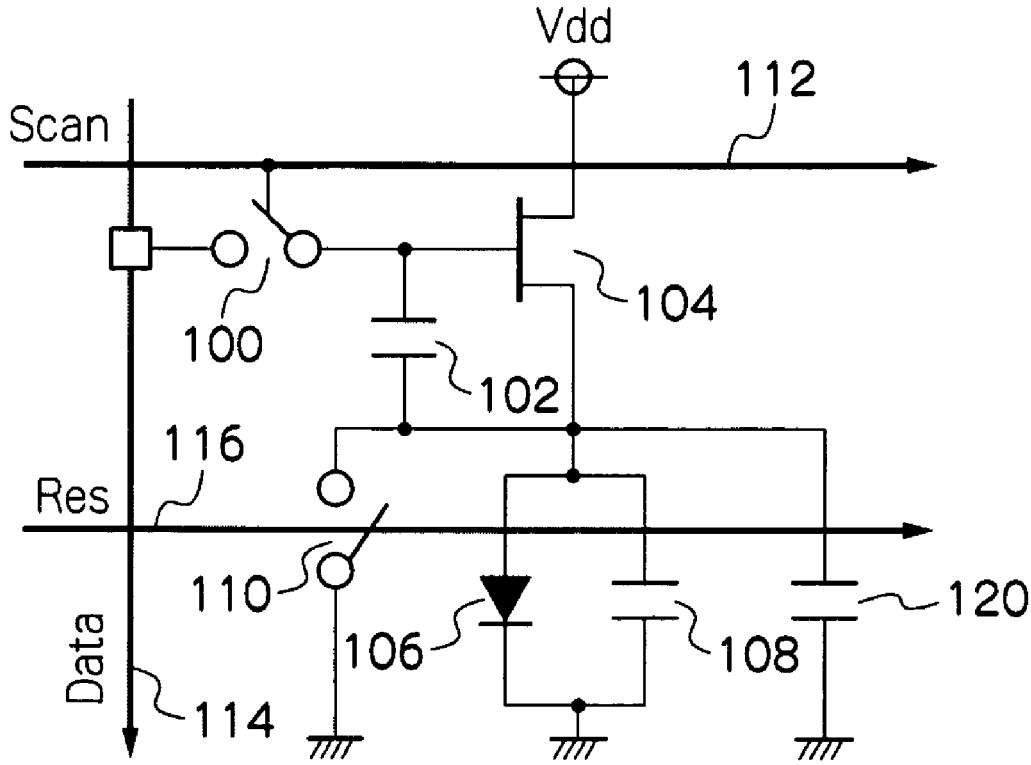
FIG. 24 PRIOR ART
FIG. 24 is an example of a circuit structure in a case in which a correction capacitor, that makes electrostatic capacity that is connected to the source of a driving transistor to be the same among RGB, is set at each pixel.

Due thereto, the open end of the discharging OLED 42 becomes a state of being connected to the open ends of the discharging OLEDs 42 of the other pixel circuits 30 of the selected row (i.e., of the other pixel circuits 30 disposed in the same row). Here, the pixel circuits of the respective pixels of the selected row are denoted as pixel circuits $\mathbf{30}_1, \mathbf{30}_2 \ldots \mathbf{30}_p$, and the respective parasitic capacitances of the discharging OLEDs 42 that are provided at the pixel circuits $\mathbf{30}_1$ through $\mathbf{30}_p$ respectively are denoted as parasitic capacitances $\mathbf{44}_1$, $\mathbf{44}_2 \ldots \mathbf{44}_p$. Looking at the pixel circuit $\mathbf{30}_1$, as shown in FIG. 11, the pixel circuit $\mathbf{30}_1$ will be equivalent to a circuit in which the loads (the parasitic capacitances $\mathbf{44}_2 \ldots \mathbf{44}_p$) of the other pixel circuits $\mathbf{30}_2$ through $\mathbf{30}_p$ of the selected row are connected to the parasitic capacitance $\mathbf{44}_1$ of the pixel circuit $\mathbf{30}_1$.

In this equivalent circuit, when the charging operation by the current Id of the driving transistor 36 of the pixel circuit $\mathbf{30}_1$ is started, the source voltage Vs rises. However, the other pixel circuits $\mathbf{30}_2$ through $\mathbf{30}_p$ are similarly operating, and therefore, the potential of the Vres line 20 becomes the average value of the source voltages Vs in the selected row.

Accordingly, during the threshold voltage Vth detecting operation, the charging/discharging currents to the parasitic capacitances 44 of the discharging OLEDs 42 will be currents corresponding to "Vth−Vth0" where Vth0 is the row average value. If there is no great deviation in the threshold voltages Vth of the driving transistors 36 of the respective pixel circuits $\mathbf{30}_1$ through $\mathbf{30}_p$ of the selected row, the parasitic capacitances 44 of the discharging OLEDS 42 do not participate in the threshold voltage Vth detecting operation.

Note that, in time period T1, the same control as in the above-described exemplary embodiment is performed. In time period T4, the open state of the Vres line 20 is cancelled, and the Vres line 20 is set to the cathode potential of the discharging OLED 42. Other than that, the same control as in the above-described exemplary embodiment is performed.

Namely, in time periods T2 and T3, by opening the Vres line 20, effects that are similar to those of FIG. 10 may be achieved, and there is no need to increase the number of transistors.

In this way, in the exemplary embodiment, the second diode element can be used as a reset switch that promotes discharging of the retention capacitor and the parasitic capacitances of the first diode element, by connecting the anode of the second diode element, whose cathode is connected to the discharge line, to the source of the driving transistor, in addition to the first diode element. Accordingly, in a system that corrects the threshold voltage by the operation of charging the parasitic capacitance of the first diode element, the source voltage of the driving transistor can be reset in a short time without adding a transistor and without depending on natural discharging. The second diode element can be manufactured in the same manufacturing process of the first diode element. Therefore, a decrease in the yield can be prevented and a decrease in the aperture ratio also can be prevented, more so than in a case in which a transistor of a separate structure than the diode element is separately manufactured and added. The second diode element may be an OLED, or a light-emitting element, that has a low light-emitting efficiency or does not perform light-emitting operation.

In the above-described aspect, the first and second diode elements may be formed by dividing a single light-emitting diode, and the second diode element emits the same reference color light as the first diode element in accordance with operation of the driving transistor.

Due to such a structure, the first diode element and the second diode element can be manufactured in the same manufacturing process. The manufacturing efficiency is improved, a decrease in yield can be prevented, and a decrease in the aperture ratio also can be prevented.

In the above-described structure, the light-emitting diodes of the plural pixel circuits may emit lights of plural reference colors, and division ratios when dividing the light-emitting diodes into the first diode elements and the second diode elements are ratios such that parasitic capacitance values of the first diode elements are substantially the same for each of the plural reference colors.

Due to such a structure, the effects of deviations at the parasitic capacitances of the respective first diode elements among plural reference colors can be suppressed, and errors of the threshold voltages and the like due to color deviations can be suppressed. The reference colors are, for example, the three primary colors of light (R (Red), G (Green), B (Blue)).

By dividing the diode at a dividing ratio such that the parasitic capacitance of the light-emitting elements are common among the plural reference colors, errors of the threshold voltages and the like due to color deviations can be suppressed.

The first aspect may further include a control circuit, wherein the control circuit turns the selection transistor on, supplies a reset voltage to the discharge line, and supplies a fixed voltage to the data line, thereby discharging the retention capacitor and a parasitic capacitance of the first diode element to the discharge line via the second diode element and resets a source voltage of the driving transistor, maintains both an on state of the selection transistor and supply of the fixed voltage to the data line, and changes a voltage of the discharge line from the reset voltage to a cathode potential of the second diode element, and charges the parasitic capacitance of the first diode element and a parasitic capacitance of the second diode element for a predetermined time period, thereby causing a threshold voltage of the driving transistor to be held at the retention capacitor, maintains both the on state of the selection transistor and supply of the cathode potential of the second diode element to the discharge line, and supplies to the data line a voltage obtained by adding an overdrive voltage to the fixed voltage, thereby causing a voltage that is obtained by adding the overdrive voltage to the threshold voltage to be held at the retention capacitor, and maintains the supply of the cathode potential of the second diode element to the discharge line and turns the selection transistor off, thereby causing the first diode element, or both the first diode element and the second diode element, to emit light using a voltage held at the retention capacitor.

By providing such a control circuit, the source voltage of the driving transistor can be reset in a short time using the second diode element and without adding a transistor.

In the above-described structure, the control circuit may further perform correction of mobility by maintaining the on state of the selection transistor, the supply of the cathode potential of the second diode element to the discharge line, and supply to the data line of the voltage obtained by adding the overdrive voltage to the fixed voltage, for a predetermined time period before causing the first diode element, or both the first diode element and the second diode element, to emit light using the voltage held at the retention capacitor.

Due to such control, correction of the mobility can be performed in the same way as conventionally.

In the above-described structure, immediately after starting resetting of the source voltage of the driving transistor, the control circuit may further supply a voltage of a predetermined magnitude for promoting discharging to the discharge line as the reset voltage, and thereafter, gradually reduce the magnitude of the reset voltage supplied to the discharge line until the source voltage of the driving transistor is reset.

When the magnitude of the parasitic capacitance of the second diode element is designed so as to be sufficiently smaller than the magnitude of the parasitic capacitance of the first diode element, the current that flows to the second diode element (the discharge current) becomes small when resetting the source voltage, and the time needed for resetting will be long. Therefore, the need to apply a larger (lower) reset voltage arises, but if a larger reset voltage is applied, the rise in the source voltage becomes greater than needed when the resetting ends. Accordingly, by initially applying a large reset voltage and gradually making the reset voltage smaller in this way, both promoting of discharging and suppression of a rise in the source voltage at the time of canceling resetting can be achieved.

The display device may further include a control circuit, wherein the control circuit turns the selection transistor on, supplies a reset voltage to the discharge line, and supplies a fixed voltage to the data line, thereby discharging the retention capacitor and the parasitic capacitance of the first diode element to the discharge line and resets a source voltage of the driving transistor, maintains both an on state of the selection transistor and supply of the fixed voltage to the data line, increases a voltage of the discharge line from the reset voltage to a voltage that is within a predetermined range of less than or equal to a value of the source voltage of the driving transistor that is reset, thereafter, electrically disconnects the discharge line from a power supply voltage and opens the discharge line, and charges the parasitic capacitance of the first diode element for a predetermined time period, thereby causing a threshold voltage of the driving transistor to be held at the retention capacitor, maintains both the on state of the selection transistor and an open state of the discharge line, and supplies to the data line voltage obtained by adding an overdrive voltage to the fixed voltage, thereby causing a voltage that is obtained by adding the overdrive voltage to the threshold voltage to be held at the retention capacitor, and turns the selection transistor off and sets a potential of the discharge line to a cathode potential of the second diode element, thereby causing both the first diode element and the second diode element to emit light using a voltage held at the retention capacitor.

By providing such a control circuit, not only can the source voltage of the driving transistor be reset in a short time using the second diode element and without adding a transistor, but also, the effects of deviations at the parasitic capacitances of the respective first diode elements among plural reference colors can be suppressed, and errors of the threshold voltages and the like due to color deviations can be suppressed.

In the above-described structure, wherein the control circuit may further correct mobility by maintaining the on state of the selection transistor, the open state of the discharge line, and supply to the data line of the voltage obtained by adding the overdrive voltage to the fixed voltage, for a predetermined time period before causing both the first diode element and the second diode element to emit light using the voltage held at the retention capacitor.

Due to such control, correction of the mobility can be performed in the same way as conventionally.

A second aspect of the present invention is a driving method driving the display device according to the first aspect, the method includes: turning the selection transistor on, supplying a reset voltage to the discharge line, and supplying a fixed voltage to the data line, thereby discharging the retention capacitor and the parasitic capacitance of the first diode element to the discharge line via the second diode element and resetting a source voltage of the driving transistor, maintaining both an on state of the selection transistor and supply of the fixed voltage to the data line, changing a voltage of the discharge line from the reset voltage to a cathode potential of the second diode element, and charging the parasitic capacitance of the first diode element and a parasitic capacitance of the second diode element for a predetermined time period, thereby causing a threshold voltage of the driving transistor to be held at the retention capacitor, maintaining both the on state of the selection transistor and supply of the cathode potential of the second diode element to the discharge line, and supplying to the data line a voltage obtained by adding an overdrive voltage to the fixed voltage, thereby causing a voltage that is obtained by adding the overdrive voltage to the threshold voltage to be held at the retention capacitor, and maintaining the supply of the cathode potential of the second diode element to the discharge line and turning the selection transistor off, thereby causing the first diode element, or both the first diode element and the second diode element, to emit light using a voltage held at the retention capacitor.

Owing to such a driving method, the source voltage of the driving transistor can be reset in a short time using the second diode element and without adding a transistor.

A third aspect of the present invention is a driving method driving the display device according to the first aspect and wherein the light-emitting diodes of the plural pixel circuits emit lights of plural reference colors, and division ratios when dividing the light-emitting diodes into the first diode elements and the second diode elements are ratios such that parasitic capacitance values of the first diode elements are substantially the same for each of the plural reference colors, the method includes: turning the selection transistor on, supplying a reset voltage to the discharge line, and supplying a fixed voltage to the data line, thereby discharging the retention capacitor and the parasitic capacitance of the first diode element to the discharge line and resetting a source voltage of the driving transistor, maintaining both an on state of the selection transistor and supply of the fixed voltage to the data line, increasing a voltage of the discharge line from the reset voltage to a voltage that is within a predetermined range of less than or equal to a value of the source voltage of the driving transistor that is reset, thereafter, electrically disconnecting the discharge line from a power supply voltage and opening the discharge line, and the parasitic capacitance of the first diode element is charged for a predetermined time period, thereby causing a threshold voltage of the driving transistor to be held at the retention capacitor, maintaining both the on state of the selection transistor and an open state of the discharge line, and supplying to the data line a voltage obtained by adding an overdrive voltage to the fixed voltage, thereby causing a voltage that is obtained by adding the overdrive voltage to the threshold voltage to be held at the retention capacitor, and turning the selection transistor off and setting a potential of the discharge line to a cathode potential of the second diode element, thereby causing both the first diode element and the second diode element to emit light using a voltage held at the retention capacitor.

Owing to such a driving method, not only can the source voltage of the driving transistor be reset in a short time by using the second diode element and without adding a transistor, but also, the effects of deviations at the parasitic capacitances of the respective first diode elements among plural reference colors can be suppressed, and errors of the threshold voltages and the like due to color deviations can be suppressed.

As described above, the embodiments can reset the source voltage of a driving transistor in a short time without adding a transistor, in a system that corrects threshold voltage by charging a parasitic capacitance of a light-emitting element.

What is claimed is:

1. A display device comprising:

a plurality of scan lines arranged in parallel;

a plurality of data lines arranged in parallel in a direction intersecting the plurality of scan lines;

a plurality of discharge lines respectively arranged in correspondence with the respective scan lines; and a plurality of pixel circuits disposed in correspondence with respective intersections of the plurality of scan lines and the plurality of data lines, each of the pixel circuits comprising:

a driving transistor comprising a gate and a source;

a first diode element that is one of two parts of a single light-emitting diode being divided into the two parts, the first diode element having a cathode which is connected to a power supply voltage line and having an anode which is connected to the source of the driving transistor, the first diode element functioning as a light-emitting element emitting reference color light in accordance with operation of the driving transistor;

a retention capacitor connected between the gate and the source of the driving transistor;

a selection transistor having a drain and a source, one of the drain and the source being connected to a data line of the plurality of data lines and the other of the drain and the source being connected to the gate of the driving transistor, the selection transistor turning on and off in accordance with a scan signal from a scan line of the plurality of scan lines; and a second diode element that is another one of the two parts of the single light-emitting diode, the second diode element functioning as a rectifier element and a light emitting element, having a cathode which is connected to a discharge line of the plurality of discharge lines and having an anode which is connected to the source of the driving transistor;

wherein the second diode element emits the same reference color light as the first diode element in accordance with operation of the driving transistor.

2. The display device of claim 1, further comprising a control circuit, wherein the control circuit turns the selection transistor on, supplies a reset voltage to the discharge line, and supplies a fixed voltage to the data line, thereby discharging the retention capacitor and a parasitic capacitance of the first diode element to the discharge line via the second diode element and resets a source voltage of the driving transistor, maintains both an on state of the selection transistor and supply of the fixed voltage to the data line, and changes a voltage of the discharge line from the reset voltage to a cathode potential of the second diode element, and charges the parasitic capacitance of the first diode element and a parasitic capacitance of the second diode element for a predetermined time period, thereby causing a threshold voltage of the driving transistor to be held at the retention capacitor, maintains both the on state of the selection transistor and supply of the cathode potential of the second diode element to the discharge line, and supplies to the data line a voltage obtained by adding an overdrive voltage to the fixed voltage, thereby causing a voltage that is obtained by adding the overdrive voltage to the threshold voltage to be held at the retention capacitor, and maintains the supply of the cathode potential of the second diode element to the discharge line and turns the selection transistor off, thereby causing the first diode element, or both the first diode element and the second diode element, to emit light using a voltage held at the retention capacitor.

3. The display device of claim 2, wherein the control circuit further performs correction of mobility by maintaining the on state of the selection transistor, the supply of the cathode potential of the second diode element to the discharge line, and supply to the data line of the voltage obtained by adding the overdrive voltage to the fixed voltage, for a predetermined time period before causing the first diode element, or both the first diode element and the second diode element, to emit light using the voltage held at the retention capacitor.

4. A driving method for driving the display device which includes:

a plurality of scan lines arranged in parallel;

a plurality of data lines arranged in parallel in a direction intersecting the plurality of scan lines;

a plurality of discharge lines respectively arranged in correspondence with the respective scan lines; and a plurality of pixel circuits disposed in correspondence with respective intersections of the plurality of scan lines and the plurality of data lines, each of the pixel circuits comprising:

a driving transistor comprising a gate and a source;

a first diode element having a cathode which is connected to a power supply voltage line and having an anode which is connected to the source of the driving transistor, the first diode element functioning as a light-emitting element and emitting reference color light in accordance with operation of the driving transistor;

a retention capacitor connected between the gate and the source of the driving transistor;

a selection transistor having a drain and a source, one of the drain and the source being connected to a data line of the plurality of data lines and the other of the drain and the source being connected to the gate of the driving transistor, the selection transistor turning on and off in accordance with a scan signal from a scan line of the plurality of scan lines; and a second diode element functioning as a rectifier element, having a cathode which is connected to a discharge line of the plurality of discharge lines and having an anode which is connected to the source of the driving transistor, the method comprising:

providing the first and second diodes by dividing a single light-emitting diode into two parts, turning the selection transistor on, supplying a reset voltage to the discharge line, and supplying a fixed voltage to the data line, thereby discharging the retention capacitor and the parasitic capacitance of the first diode element to the discharge line via the second diode element and resetting a source voltage of the driving transistor, maintaining both an on state of the selection transistor and supply of the fixed voltage to the data line, changing a voltage of the discharge line from the reset voltage to a cathode potential of the second diode element, and charging a parasitic capacitance of the first diode element and a parasitic capacitance of the second diode element for a predetermined time period, thereby causing a threshold voltage of the driving transistor to be held at the retention capacitor, maintaining both the on state of the selection transistor and supply of the cathode potential of the second diode element to the discharge line, and supplying to the data line a voltage obtained by adding an overdrive voltage to the fixed voltage, thereby causing a voltage that is obtained by adding the overdrive voltage to the threshold voltage to be held at the retention capacitor, and maintaining the supply of the cathode potential of the second diode element to the discharge line and turning the selection transistor off, thereby causing the first diode element, or both the first diode element and the second diode element, to emit light using a voltage held at the retention capacitor, wherein the second diode element emits the same reference color light as the first diode element in accordance with operation of the driving transistor.

5. A display device comprising:

a plurality of scan lines arranged in parallel;

a plurality of data lines arranged in parallel in a direction intersecting the plurality of scan lines;

a plurality of discharge lines respectively arranged in correspondence with the respective scan lines; and a plurality of pixel circuits disposed in correspondence with respective intersections of the plurality of scan lines and the plurality of data lines, each of the pixel circuits comprising:

a driving transistor comprising a gate and a source; a first diode element having a cathode which is connected to a power supply voltage line and having an anode which is connected to the source of the driving transistor, the first diode element emitting reference color light in accordance with operation of the driving transistor;

a retention capacitor connected between the gate and the source of the driving transistor;

a selection transistor having a drain and a source, one of the drain and the source being connected to a data line of the plurality of data lines and the other of the drain and the source being connected to the gate of the driving transistor, the selection transistor turning on and off in accordance with a scan signal from a scan line of the plurality of scan lines;

a second diode element, functioning as a rectifier element, having a cathode which is connected to a discharge line of the plurality of discharge lines and having an anode which is connected to the source of the driving transistor; and a control circuit, wherein the control circuit: turns the selection transistor on, supplies a reset voltage to the discharge line, and supplies a fixed voltage to the data line, thereby discharging the retention capacitor and a parasitic capacitance of the first diode element to the discharge line via the second diode element and resets a source voltage of the driving transistor, maintains both an on state of the selection transistor and supply of the fixed voltage to the data line, and changes a voltage of the discharge line from the reset voltage to a cathode potential of the second diode element, and charges the parasitic capacitance of the first diode element and a parasitic capacitance of the second diode element for a predetermined time period, thereby causing a threshold voltage of the driving transistor to be held at the retention capacitor, maintains both the on state of the selection transistor and supply of the cathode potential of the second diode element to the discharge line, and supplies to the data line a voltage obtained by adding an overdrive voltage to the fixed voltage, thereby causing a voltage that is obtained by adding the overdrive voltage to the threshold voltage to be held at the retention capacitor, and maintains the supply of the cathode potential of the second diode element to the discharge line and turns the selection transistor off, thereby causing the first diode element, or both the first diode element and the second diode element, to emit light using a voltage held at the retention capacitor, wherein the first and second diode elements are formed by dividing a single light-emitting diode, and the second diode element emits the same reference color light as the first diode element in accordance with operation of the driving transistor, and wherein immediately after starting resetting of the source voltage of the driving transistor, the control circuit further supplies a voltage of a predetermined magnitude for promoting discharging to the discharge line as the reset voltage, and thereafter, gradually reduces the magnitude of the reset voltage supplied to the discharge line until the source voltage of the driving transistor is reset.

* * * * *